US006634742B2

(12) United States Patent
Owaki et al.

(10) Patent No.: US 6,634,742 B2
(45) Date of Patent: Oct. 21, 2003

(54) RECORDING HEAD UNIT

(75) Inventors: Hiroshige Owaki, Nagano (JP); Fujio Akahane, Nagano (JP); Takayuki Iijima, Nagano (JP); Katsuhiro Okubo, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/794,156

(22) Filed: Feb. 28, 2001

(65) Prior Publication Data

US 2001/0030676 A1 Oct. 18, 2001

(30) Foreign Application Priority Data

| | | |
|---|---|---|
| Feb. 28, 2000 | (JP) | P.2000-051362 |
| Mar. 24, 2000 | (JP) | P.2000-083589 |
| Apr. 10, 2000 | (JP) | P.2000-108351 |
| Oct. 2, 2000 | (JP) | P.2000-302039 |
| Feb. 5, 2001 | (JP) | P.2001-027672 |

(51) Int. Cl.[7] ..... B41J 2/175
(52) U.S. Cl. ..... 347/93; 347/87; 347/92
(58) Field of Search ..... 347/65, 66, 68, 347/69, 70, 86, 87, 92, 93; 210/435, 444, 454

(56) References Cited

U.S. PATENT DOCUMENTS

| | | | | |
|---|---|---|---|---|
| 5,576,750 A | | 11/1996 | Brandon et al. | 347/87 |
| 6,019,465 A | * | 2/2000 | Shinada et al. | 347/93 |

FOREIGN PATENT DOCUMENTS

| | | |
|---|---|---|
| EP | 0 930 169 A1 | 7/1999 |

* cited by examiner

*Primary Examiner*—Anh T. N. Vo
(74) *Attorney, Agent, or Firm*—Sughrue Mion, PLLC

(57) ABSTRACT

Ink flow paths are formed that corresponds in number to the ink chambers of a mounted ink cartridge, to supply ink from the ink chambers to a recording head. These ink flow paths are constituted by first communication paths (59, 60), which communicate with the ink outlets of corresponding ink chambers, second communication paths (61, 67), which communicate with the corresponding ink inlets of the recording head, and convergent flow paths (65), which connect the first and the second communication paths and converge as they approach the recording head. Filters (56) are located in the second communication paths.

50 Claims, 21 Drawing Sheets

RECORDING HEAD UNIT

BACKGROUND OF THE INVENTION

1. Technical Field

The present invention relates to a recording head unit appropriate for an ink-jet recording apparatus for ejecting ink droplets to record images, such as characters, on a recording medium.

2. Related Art

Some of ink-jet recording apparatuses (hereinafter referred to as "recording apparatuses"), such as printers, plotters and facsimile machines, have a recording head unit obtained by integrally forming a cartridge holder to which an ink cartridge is replaceably mounted, and a recording head for ejecting ink as a pressure generating element is activated. In use, an ink cartridge is mounted to the cartridge holder of the recording head unit, so that the ink contained in the ink cartridge is supplied to the recording head via an ink flow path. The recording head can be continuously used for an extended period of time by replacing the ink cartridge.

The recording head unit of this type is required to prevent a foreign substance, such as dust, from entering the recording head, because the entering substance causes ink clogging or a feeding failure. Therefore, the recording head unit generally has a filter located inside an ink supply needle that is inserted into the ink cartridge. After undesirable substances have been removed from the ink by the filter, the ink is supplied to the recording head.

To surely prevent the foreign substrate from entering the recording head unit of this type, the unit is subjected to the following cleaning process during the manufacture. That is, foreign substances present along the ink flow path downstream of the filter are removed by first supplying a cleaning liquid in the direction in which the ink flows and then in the opposite direction. Since if this process is improperly performed not all foreign substances will be removed, and they will later, during ordinary use, be carried into the recording head, this cleaning process is performed for an adequate long period of time for completeness.

Demands exist for smaller recording heads and larger capacity ink cartridges. This is because smaller recording heads will make it possible to reduce manufacturing costs, and larger capacity ink cartridges will enhance user convenience. Manufacturing costs will come down if the size of a recording head is reduced because component part sizes will also be reduced, as in the case for a silicon flow path formation substrate, one of the more expensive parts used in a recording head, for which the cost of production will drop because a single silicon wafer will yield more substrates. And enhanced user convenience will be provided if the capacity of ink cartridges is increased because more print will be executed with a single cartridge and the ink cartridge replacement cycle will be extended.

However, to increase the sizes of ink cartridges and to reduce the sizes of recording heads, extended ink flow paths will be needed, and accordingly, longer cleaning times will be required. And if cleaning times are increased, manufacturing costs will rise because manufacturing efficiency will be reduced. This is unavoidable because if to avoid a rise in production costs the cleaning times were maintained or were shortened, ink flow paths would be insufficiently cleaned and not all foreign substances would be removed, and the yield would be reduced.

To resolve these problems, it is one objective of the present invention to provide a recording head unit that can surely prevent the entry of any foreign substances into a recording head.

It is another objective of the invention to provide a recording head unit that can be efficiently manufactured even when an ink flow path is extended.

SUMMARY OF THE INVENTION

To achieve the above objectives, according to a first aspect of the invention, a recording head unit comprises:

a cartridge holder adapted to replaceably mount at least one an ink cartridge defining a plurality of ink chambers;

a recording head, for ejecting ink in response to activation of a pressure generating element;

a plurality of ink flow paths through which ink in the ink chambers is supplied to the recording head, respectively, each of the ink flow paths including a first communication path communicated with an ink outlet of the corresponding ink chamber, a second communication path communicated with a corresponding ink inlet of the recording head, and a convergent flow path communicating the first communication path with the second communication path, the convergent flow paths being arranged to converge toward the recording head; and filters respectively disposed in the second communication paths.

The phrase "at least one ink cartridge defining a plurality of ink chambers" is intended to mean not only a single ink cartridge having a plurality of ink chambers, but also a plurality of ink cartridges, each having a single ink chamber. Of course, a combination of these ink cartridges also falls within the scope of this phrase so long as a plurality of ink chambers are defined.

According to a second aspect, in the recording head unit of the first aspect, each of the convergent flow paths is downwardly inclined from the corresponding first communication path to the second corresponding communication path.

According to a third aspect, in the recording head unit of the first aspect, each of the convergent flow paths extends horizontally.

It should be noted that the horizontal direction includes an inclination that does not greatly affect head difference.

According to a fourth aspect, in the recording head unit of the third aspect, the convergent flow paths are formed in a convergent flow path unit in the form of a plate.

According to a fifth aspect, in the recording head unit of the fourth aspect, the convergent flow path unit includes a flow path grooved plate having a plurality of flow path grooves for forming the convergent flow paths, and a lid plate for closing openings of the flow path grooves.

According to a sixth aspect, in the recording head unit of the fifth aspect, the lid plate has flexible portions at least partially sealing the flow path grooves, and each of the flexible portions is elastically deformable by pressure change in the ink flowing along the corresponding convergent flow path.

According to a seventh aspect, in the recording head unit of the fifth or sixth aspect, a first communication portion provided with the first communication paths is integral with the lid plate.

According to an eighth aspect, in the recording head unit of one of the fifth to the seventh aspects, the second communication paths are formed in the flow path groove plate, and filter holders, for holding the filters, are positioned at the upstream ends of the second communication paths.

According to a ninth aspect, in the recording head unit of one of the fifth to the eighth aspects, protrusions are formed, on joining face of the lid plate to the flow path grooved plate, that are narrower than widths of the openings of the flow path grooves and lower than depths of the flow path grooves; and wherein, when the lid plate and the flow path grooved plate are joined together in a state that the protrusions are fitted to the flow path grooves, gaps are defined between side walls of the protrusions and inner walls of the flow path grooves.

According to a tenth aspect, in the recording head unit of the fourth aspect, the convergent flow path unit comprises an opening plate, in which through holes that serve as the convergent flow paths are formed in the direction of the thickness of the convergent flow path unit, an upper lid plate, for sealing upper openings of the through holes, and a lower lid plate, for sealing lower openings of the through holes.

According to an eleventh aspect, in the recording head unit of the tenth aspect, a first communication unit, a first communication portion provided with the first communication paths, is an integral with the upper lid plate.

According to a twelfth aspect, in the recording head unit of the tenth and the eleventh aspects, the second communication paths are formed in the lower lid plate, and filter holders, for holding the filters, are located at upstream ends of the second communication paths.

According to a thirteenth aspect, in the recording head unit of the fourth aspect, the convergent flow path unit includes an upper flow path grooved plate, in which upper flow path grooves are formed to constitute upper portions of the convergent flow paths, and a lower flow path grooved plate, in which lower flow path grooves are formed to constitute lower portions of the convergent flow paths.

According to a fourteenth aspect of the invention, in the recording head unit of the thirteenth aspect, the second communication paths are formed in the lower flow path grooved plate, and filter holders, for holding the filters, are positioned at upstream ends of the second communication paths.

According to a fifteenth aspect of the invention, in the recording head unit of the seventh or eleventh aspect, the first communication portion is constituted by ink supply needles that are inserted into the at least one ink cartridge to supply ink from the ink chambers.

According to a sixteenth aspect of the invention, in the recording head unit of one of the fourth to the fifteenth aspects, at least one of plates that constitute the convergent flow path unit is formed of a transparent or semi-transparent material.

Here, the term transparent or semi-transparent material is intended to mean a material through which objects on its opposite side are visible.

According to a seventeenth aspect of the invention, in the recording head unit of one of the fourth to sixteenth aspects, plates constituting the convergent flow path unit are joined together by thermal welding.

According to an eighteenth aspect of the invention, in the recording head unit of one of the fourth to sixteenth aspects, plates constituting the convergent flow path unit are joined together by an adhesive.

According to a nineteenth aspect of the invention, in the recording head unit of the eighteenth aspect, the adhesive flows easily, and recessed portions in which excessive adhesive can be accommodated are formed around adhered areas.

According to a twentieth aspect of the invention, in the recording head unit of one of the fourth to sixteenth aspects, plates that constitute the convergent flow path unit are joined together by ultrasonic welding.

According to a twenty-first aspect of the invention, in the recording head unit of one of the first, seventh, ninth to eleventh, thirteenth, and fifteenth to twentieth aspects, the filters are located at intermediate portions of the second communication paths; and wherein portions of the second communication paths, upstream of the filters, are increased in diameter as the portions approach the filters.

According to a twenty-second aspect of the invention, in the recording head unit of one of the first to twenty-first aspects, portions of the second communication units, downstream of the filters, are decreased in diameter toward a downstream side to present a funnel shape.

According to a twenty-third aspect of the invention, in the recording head unit of one of the first to twenty-second aspects, air bubble holding spaces, in which air bubbles are to be retained, are formed in intermediate portions of the ink flow paths.

According to a twenty-fourth aspect of the invention, in the recording head unit of the twenty-third aspect, the air bubble holding spaces include first air bubble holding spaces formed by partially increasing the diameters of the first communication paths.

According to a twenty-fifth aspect of the invention, in the recording head unit of the twenty-third or twenty-fourth aspect, the air bubble holding spaces include second air bubble holding spaces formed by partially increasing the diameters of the ink flow paths, the second air bubble holding spaces being adjacent to an upstream of the filters.

According to a twenty-sixth aspect of the invention, in the recording head unit of the twenty-third aspect, the air bubble holding spaces include first air bubble holding spaces, formed by partially increasing the diameters of the first communication paths, and second air bubble holding spaces, formed by partially increasing the diameters of ink flow paths, the second air bubble holding spaces being adjacent to and upstream of the filters; and wherein the volume of each of the first air bubble holding spaces is greater than the volume of each of the second air bubble holding spaces.

According to a twenty-seventh aspect of the invention, in the recording head unit of one of the second to twenty-sixth aspects, ceiling faces of the convergent flow paths incline upward from the second communication paths to the first communication paths.

According to a twenty-eighth aspect of the invention, in the recording head unit of one of the first to twenty-seventh aspects, different types of ink are stored in the ink chambers; and wherein the ink flow paths are respectively formed for the different types of ink.

The phrase "types of ink" is intended to mean not only ink types different in color, but also ink types different in coloring material, such as dye-based ink and pigment-based ink, and ink types of high permeability and low permeability, i.e., different in permeability relative to recording media.

According to a twenty-ninth aspect of the invention, in the recording head unit of one of the first to twenty-eighth aspects, the convergent flow paths have the same length.

According to a thirtieth aspect of the invention, the recording head unit of one of the first to twenty-ninth aspects further includes:

nozzle openings, through which ink droplets are to be ejected; and pressure generation chambers communicated with the nozzle openings, wherein ink pressure in a desired one of the pressure generation chambers is changed by the pressure to eject the ink droplets through the corresponding nozzle opening, and wherein piezoelectric vibrators, which can vary the volumes of the respective pressure generation chambers, are employed as the pressure generating element.

According to a thirty-first aspect of the invention, in the recording head unit of the thirtieth aspect, the piezoelectric vibrators are piezoelectric vibrators of a vertical vibration mode.

According to a thirty-second aspect of the invention, the recording head unit of one of the first to twenty-ninth aspects further comprises:

nozzle openings, through which ink droplets are ejected; and pressure generation chambers communicated with the nozzle openings, wherein ink pressure in a desired one of the pressure generation chambers is changed by the pressure generating element to eject the ink droplets through the corresponding nozzle opening, and wherein heat generation devices that can generate air bubbles in the respective pressure generation chambers are employed as the pressure generating element.

The present disclosure relates to the subject matter contained in Japanese patent application No. 2000-051362 (filed on Feb. 28, 2000), Japanese patent application No. 2000-083589 (filed on Mar. 24, 2000), Japanese patent application No. 2000-108351 (filed on Apr. 10, 2000), Japanese patent application No. 2000-302039 (filed on Oct. 2, 2000), and Japanese patent application No. 2001-027672 (filed on Feb. 5, 2001), which are expressly incorporated herein by reference in their entireties.

BRIEF DESCRIPTION OF THE DRAWINGS

FIG. 13A is a side, cross-sectional view, FIG. 13B is a bottom view of a base plate.

FIG. 14A is an explanatory diagram for the base plate, FIG. 14B is an explanatory diagram for the grooved plate and FIG. 14C is a cross-sectional view of the state wherein the base plate and the grooved plate area are bonded.

DESCRIPTION OF THE PREFERRED EMBODIMENT

The preferred embodiments of the invention will now be explained while referring to the accompanying drawings. In the following embodiments, the invention is applied to a recording head unit for an ink-jet printer (hereinafter referred to as a printer).

Figure 1:
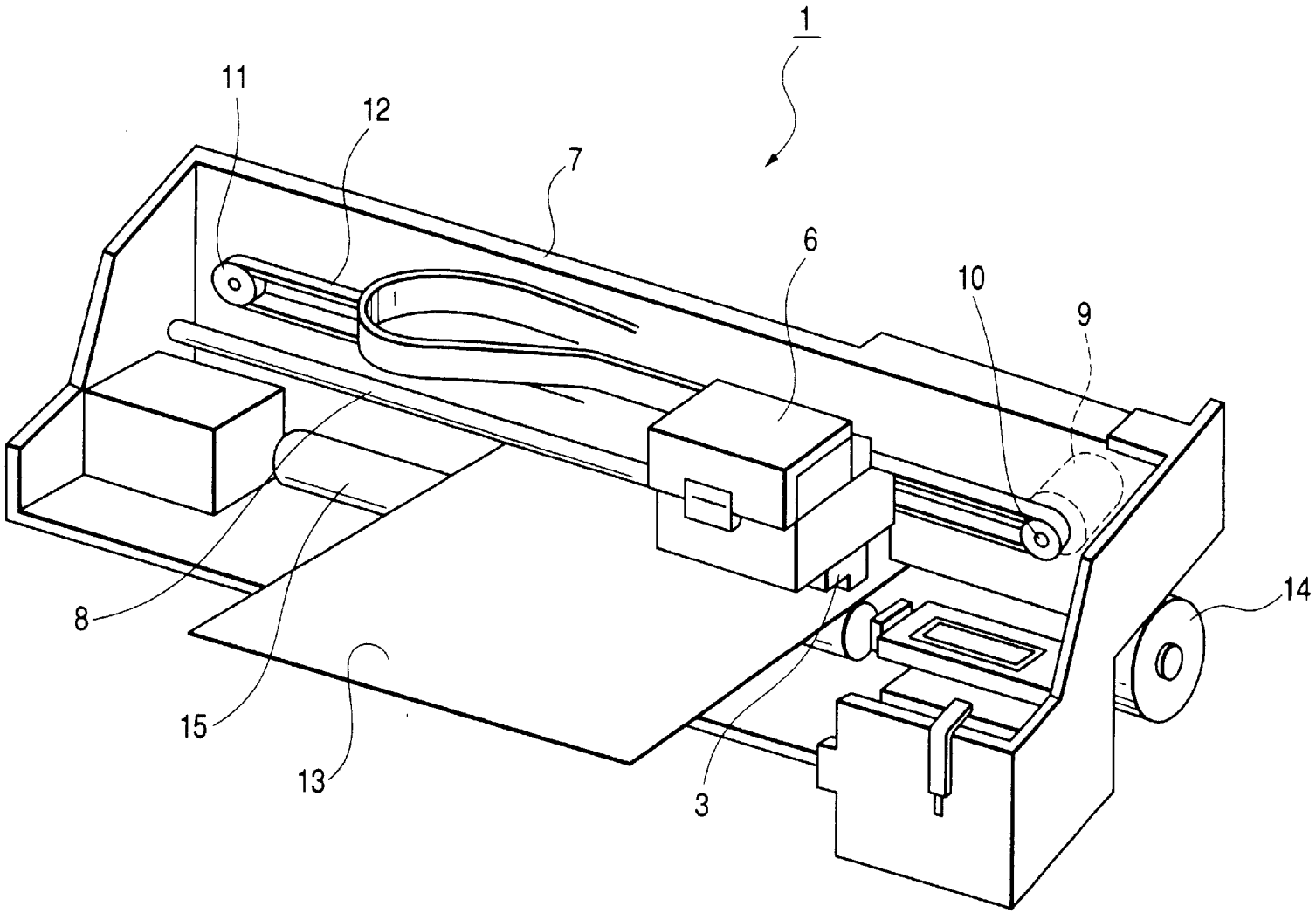
FIG. 1 is a perspective view for explaining the configuration of an ink-jet printer according to a first embodiment of the invention.
Figure 2:
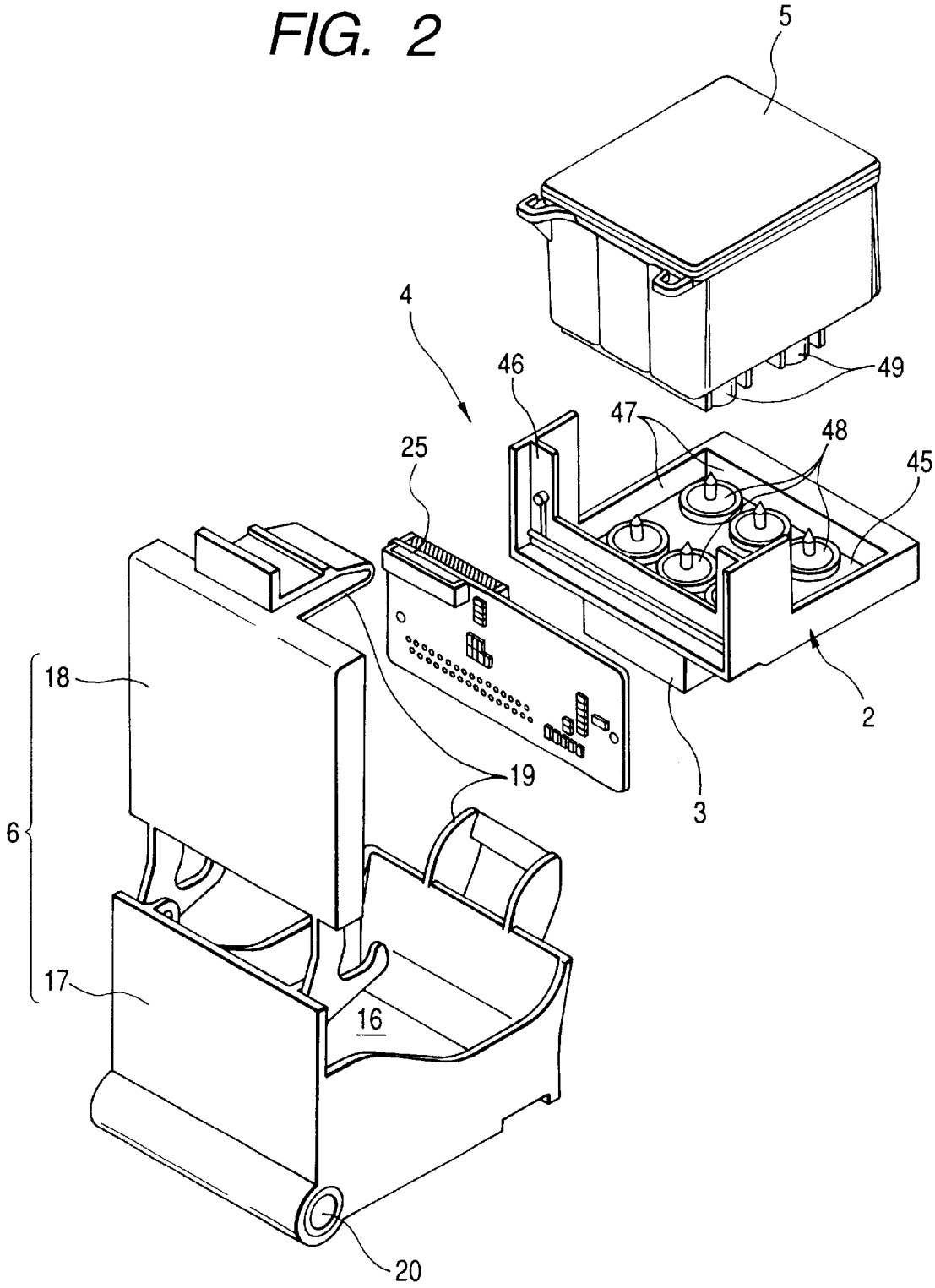
FIG. 2 is an exploded perspective view of a carriage, a head unit and an ink cartridge.

As is shown in FIGS. 1 and 2, a printer 1 comprises: a recording head unit (hereinafter referred to as a head unit) 4, constituted by a cartridge case 2 and a recording head 3 as an integral unit; an ink cartridge 5, which is replaceably attached to the cartridge case 2 and stores different types of ink in respective ink tanks; a carriage 6, to which the head unit 4 is attached; and a head scanning mechanism, for moving the carriage 6 reciprocatingly in the main scanning direction.

The carriage 6 is movably attached to a guide bar (guide member) 8 mounted in a case 7, and is moved right and left horizontally (i.e., in the main scanning direction), along the guide bar 8, by the head scanning mechanism.

The head scanning mechanism comprises: a pulse motor 9, positioned at one lateral end of the case 7; a drive pulley 10, connected to the rotary shaft of the pulse motor 9; an idle pulley 11, provided at the other lateral end of the case 7; a timing belt 12, suspended between the drive pulley 10 and the idle pulley 11 and connected to the carriage 6; and a printer controller (not shown), for controlling the rotation of the pulse motor 9. That is, the head scanning mechanism drives the pulse motor 9 to reciprocatingly move the carriage 6, i.e., moves the recording head 3, in the direction of the width of a recording sheet 13, which is one type of a printing medium.

The printer 1 also has a sheet feeding mechanism for feeding the recording sheet 13 in the sub-scanning direction, perpendicular to the main scanning direction. The sheet feeding mechanism includes a sheet feed motor 14, a sheet feed roller 15, and the printer controller.

Based on print data transmitted by a host computer, the printer controller controls the recording head 3, the pulse motor 9, the sheet feed motor 14 and so on to move the recording head 3 in the main scanning direction and to sequentially feed the recording sheet 13 in the sub-scanning direction in linking with the main scanning motion.

Figure 3:
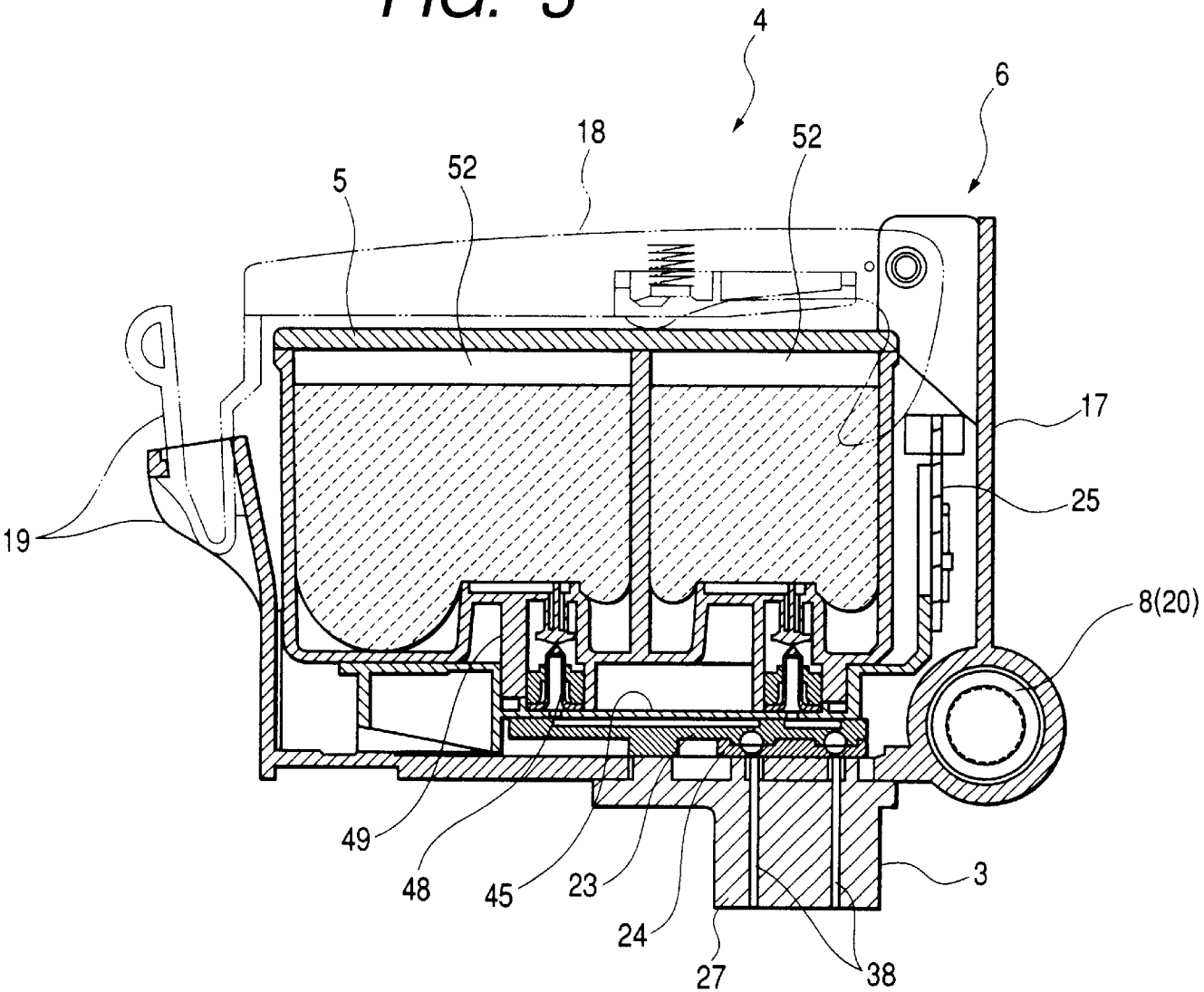
FIG. 3 is a cross-sectional view of the state wherein the carriage, the head unit and the ink cartridge are assembled.

The carriage 6 and the head unit 4 will now be described. FIG. 2 is a rear, exploded perspective view of the carriage 6, the head unit 4 and the ink cartridge 5, and FIG. 3 is a cross-sectional view in the assembled state.

A cartridge chamber 16, whose top can be opened, is integrally formed in the carriage 6, and the ink cartridge 5 is accommodated in the cartridge chamber 16 to be replaceable.

The carriage 6 is a parallelepiped hollow box that is constituted mainly by a carriage main body 17 and an upper lid 18. The upper lid 18 is opened or closed by a hinge mechanism that is located at the upper rear end of the carriage main body 17. An engagement mechanism 19 is provided on the front of the carriage 6 for engagement and disengagement between the main body 17 and the lid 18. Therefore, the upper lid 18 is maintained in the closed state by the engagement mechanism 19. Further, a laterally penetrating guide hole 20 is formed at the rear lower end of the carriage main body 17, and the guide bar 8 is passed through the guide hole 20. Thus, the carriage 6 is movably supported by the guide bar 8.

The head unit 4 is mainly constructed by the recording head 3, the cartridge case 2, a grooved plate 23 (see FIG. 6), a filter attachment panel 24 (see FIG. 6), and a head plate 25.

Figure 4:
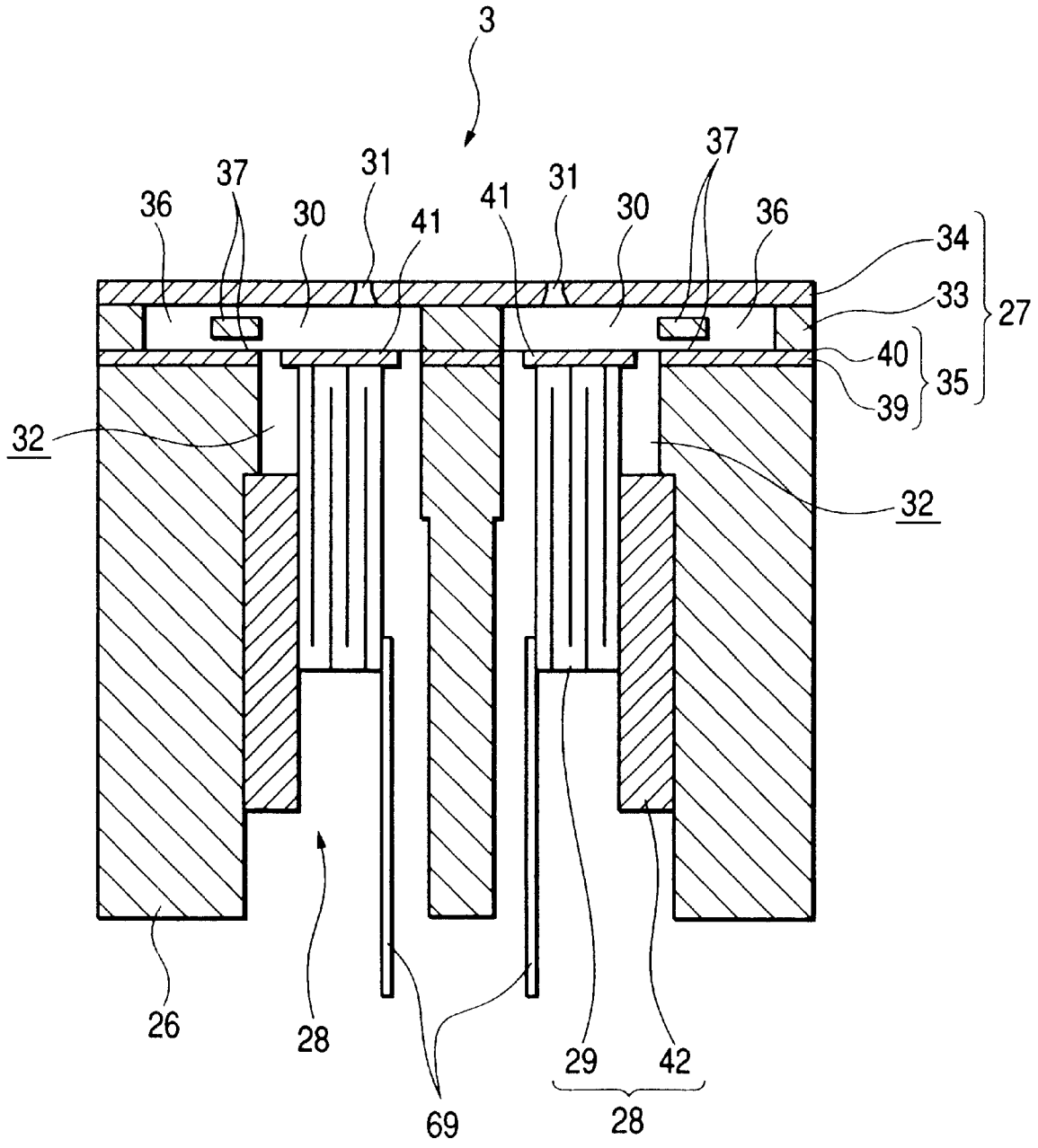
FIG. 4 is a cross-sectional view of a recording head.

As is shown in FIG. 4, the recording head 3 is so designed that a flow path unit 27 is joined to the distal end of a head case 26. With this arrangement, a piezoelectric vibrator 29, which is part of a vibrator unit 28 stored in the head case 26, induces a pressure change in an associated pressure generation chambers 30 in the flow path unit 27, so that ink droplets are ejected through nozzle openings 31.

The head case 26 is a block member molded of a thermosetting resin, such as an epoxy-based resin, and in the head case 26, accommodation spaces 32 are defined, each accommodating the corresponding vibrator unit 28.

The flow path unit 27 is designed so that a nozzle plate 34 is joined to one face of a flow path formation substrate 33, while a vibration plate 35 is joined to the other face. The flow path formation substrate 33 is made of silicone, and partition walls are formed by etching a silicon wafer, so that the pressure generation chambers 30, which communicate with the nozzle openings 31, common ink chambers 36, and a plurality of ink supply paths, which extend from the common ink chambers 36 to the pressure generation chambers 30, are adequately defined by the partition walls. A connection port, which is connected to a corresponding ink supply path 38 (see FIG. 3) is provided for each of the common ink chambers 36, and ink stored in the ink cartridge 5 is supplied via the connection port to the common ink chamber 36. The nozzle openings 31 in the nozzle plate 34 are arranged in a row at pitches corresponding to the dot formation density. The vibration plate 35 has a double structure, wherein an elastic film 40 is laminated on a support plate 39, and parts of the support plate 39 corresponding in location to the pressure generation chambers 30 are removed in an annular manner, so that island portions 41 are formed inside the rings.

The vibrator unit 28 is constituted by a fixing plate 42 and a plurality of the piezoelectric vibrators 29. The piezoelectric vibration 29 is one type of a pressure generating element. The piezoelectric vibrators 29 are provided, for example, by preparing a single laminated piezoelectric substrate in which piezoelectric layers and electrode layers are alternately laminated, and forming slits in the thus obtained laminated piezoelectric substrate at predetermined pitches corresponding to the pressure generation chambers 30 of the flow path unit 27 to present a comb shape having tooth. The comb tooth can serve as the piezoelectric vibrator 29. The piezoelectric vibrator 29 in this embodiment is of a vertical vibration mode in which the vibrator 29 is extended or contracted in a direction perpendicular to the direction in which the piezoelectric and electrode layers are laminated, i.e., the longitudinal direction of the element. The fixing plate 42, i.e. a plate member securely fixed to the base end of the comb-like substrate, is made of stainless steel.

The vibrators 28 are inserted into the accommodation spaces 32 of the case, so that the distal ends of the piezoelectric vibrators 29 are confronted with the openings. In this state, the distal ends of the piezoelectric vibrators 29 are fixed to the corresponding island portions 41 of the vibration plate 35 in contact therewith.

Upon the application of a potential difference between opposite electrodes, the piezoelectric vibrator 29 is extended or contracted longitudinally to displace the elastic film 40 that defines the associated pressure generation chamber 30. As the piezoelectric vibrator 29 is extended or contracted, the volume of the associated pressure generation chamber 30 is changed, and the pressure imposed on the ink in the pressure generation chamber 30 fluctuates. The recording head 3 employs the fluctuating pressure imposed on the ink to eject ink droplets from the nozzle opening 31.

The cartridge case 2 is a member that functions as a cartridge holder in this embodiment, and is constructed by a frame member. That is, as is shown in FIG. 2, the cartridge case 2 includes a flat base plate 45, a vertical plate attachment portion 46, which is provided upright from the rear of the base plate 45, and a vertical rib 47, which is provided along the front edge and the right and left side edges of the base plate 45. The ink cartridge 5 is mounted to the upper face of the base plate 45.

Figure 7:
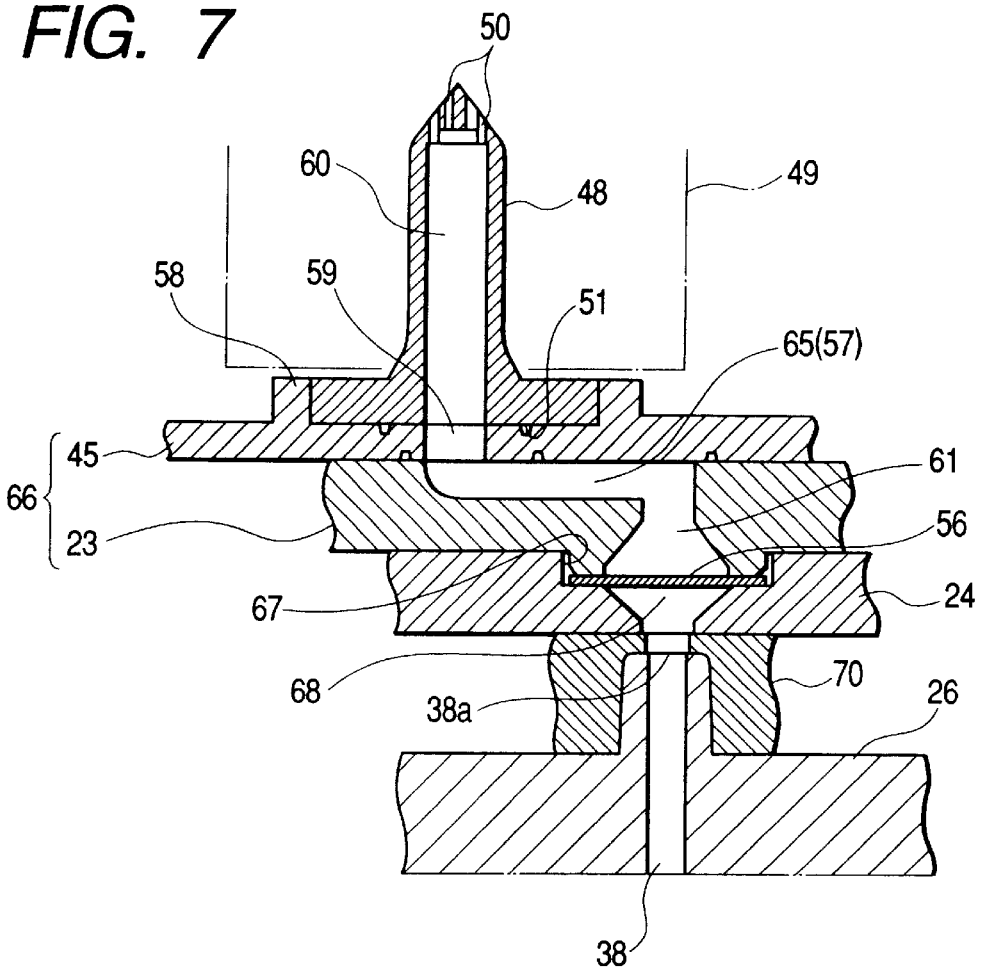
FIG. 7 is a cross-sectional view of the structure of the head unit.

A plurality of hollow ink supply needles 48 are joined upright to the upper face of the base plate 45. The ink supply needle 48 functions as a first communication portion in the present embodiment, and is inserted into a corresponding needle connector 49 of the ink cartridge 5. The conical distal end of the ink supply needle 48 facilitates the insertion into the needle connector 49. Further, as is shown in FIG. 7, a plurality of ink guide holes 50 are formed in the distal end of each of the ink supply needles 48 to communicate the inside and outside of the needle 48, and a rib 51, for ultrasonic welding, is formed on the reverse side of the base of each ink supply needle 48. That is, ultrasonic welding is used to join the ink supply needles 48.

As is shown in FIG. 3, the needle connectors 49 function as ink outlets for the ink chambers 52, and the distal ends of the needle connectors 49 are sealed by a common film or respective films until the ink cartridge 5 is mounted to the cartridge case 2. When the cartridge 5 is accommodated and held in the cartridge accommodation chamber 16 so that the ink cartridge 5 is mounted to the cartridge case 2, the ink supply needles 48 penetrate the film or films and are inserted into the needle connectors 49. When the ink supply needles 48 are inserted into the needle connectors 49, the ink in the ink chambers 52 is introduced to the inner spaces of the corresponding ink supply needles 48.

The head plate 25, on which an electric circuit for driving the recording head 3 is mounted, is attached to the base plate attachment portion 46.

A detail explanation for the head unit 4 will be given later.

The ink cartridge 5 will now be described.

Figure 5:
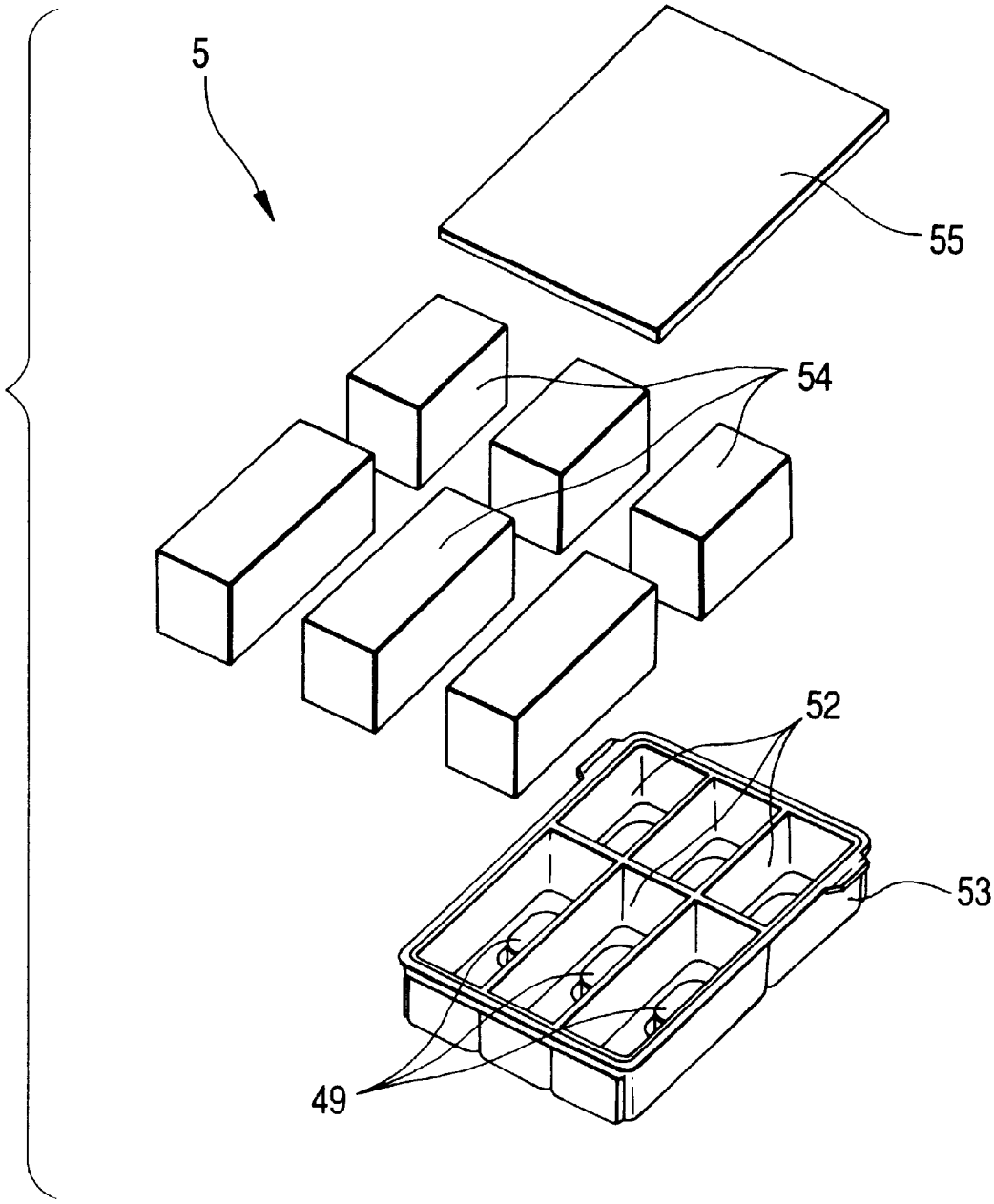
FIG. 5 is an exploded perspective view of the structure of the ink cartridge.

As is shown in FIG. 5, the ink cartridge 5 comprises: a hollow, box-shaped case main body 53 that is internally divided into ink chambers 52; ink absorption members 54, respectively stored in the ink chambers 52 to absorb and hold ink; and a flat plate-shaped case lid 55, for covering the upper opening of the case main body 53. The needle connectors 49 are formed on the bottoms of the ink chambers 52 in the case main body 53.

The internal space of the exemplified ink cartridge 5 is divided into two sections longitudinally and into three sections laterally, so that a total of six ink chambers 52 are defined. The ink absorption members 54 stored in the respective ink chambers 52 absorb and hold (i.e., store) six color types of ink, i.e. cyan, magenta, yellow, light cyan, light magenta and black.

The types of ink stored in the ink cartridge 5 should not be limited to the different color types, and plural types of ink, different in coloring material, such as dye-based ink (a type of ink having high permeable speed) and pigment-based ink (a type of ink having low permeable speed) may be stored in the ink cartridge. For example, in the case of the cartridge having six ink chambers 52, cyan, magenta and yellow of dye-based ink and cyan, magenta and yellow of pigment-based ink may be separately contained in the six ink chambers 52.

The volumes of each ink chamber 52 and each ink absorption member 54 are appropriately determined in accordance with the usage frequencies, i.e. the estimated consumption of the individual colors or types.

Figure 6:
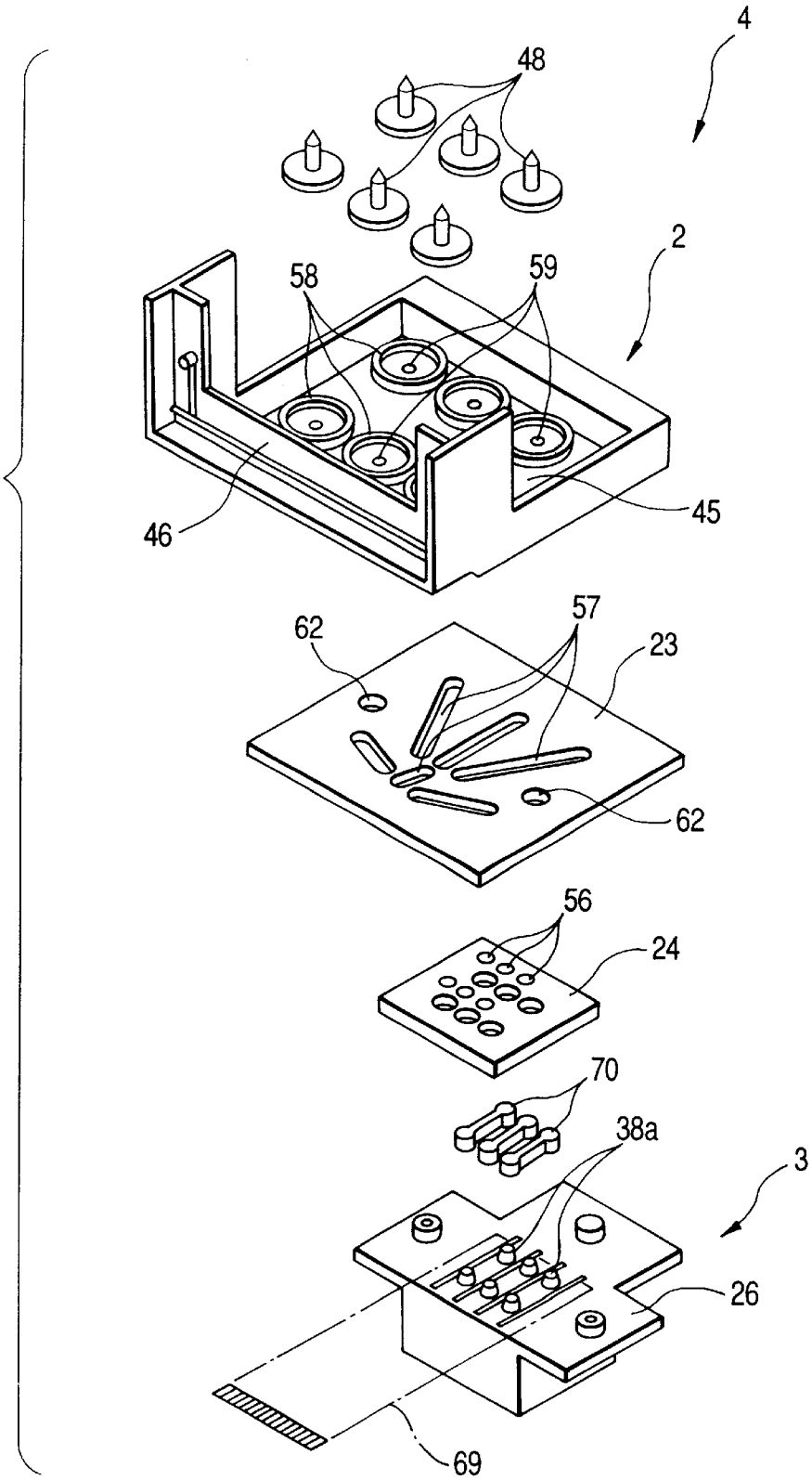
FIG. 6 is an exploded perspective view of the head unit.
Figure 8:
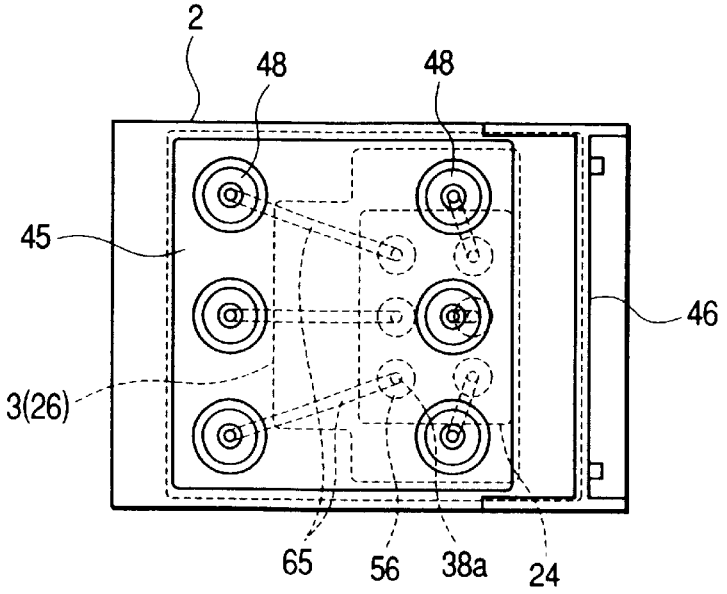
FIG. 8 is a schematic diagram showing ink flow paths.

The structure of the head unit 4 will now be described in detail. FIG. 6 is an exploded perspective view of the disassembled head unit 4, FIG. 7 is a cross-sectional view of the structure of the head unit 4, and FIG. 8 is a schematic diagram showing the ink flow paths.

The head unit 4 is an integral unit constructed by the cartridge case 2, located at the topmost position; the grooved plate 23, which is joined to the lower face of the cartridge case 2; the plate-like filter attachment panel 24, which is joined to the lower face of the grooved plate 23; and the recording head 3, which is attached to the lower face of the filter attachment panel 24. In the head unit 4, a plurality of ink flow paths (see FIG. 7: one of the flow paths is shown, which extends from an inner space 60 to a hole 68 below a filter) are formed that correspond to the ink chambers 52, and that extend from the ink supply needles 48, via convergent flow paths 65, to inlet ports 38*a* (corresponding to ink inlets in this embodiment) of the ink supply pipes 38 of the recording head 3.

The base plate 45 of the cartridge case 2 functions as a lid plate in this embodiment, and seals the openings of flow path grooves 57 formed in the grooved plate 23. A plurality of ring-shaped bases 58 having bottoms are provided on the upper face of the base plate 45, to which the ink supply needles 48 are respectively joined. In this embodiment, six bases 58 are provided for corresponding six ink supply needles 48. In other words, the ink supply needles 48 that are provided are equal in number to the ink chambers 52 of the ink cartridge 5. Upstream side through holes 59 that pierce the base plate 45 in the thickness direction thereof are formed in the centers of the bases 58. The upstream side through holes 59 communicate with the inner spaces 60 in the ink supply needles 48 when the ink supply needles 48 are attached to the bases 58. That is, the upstream side through hole 59, together with the inner space 60 of the ink supply needle 48, constitutes a first communication path in this embodiment, and communicate with the convergent flow path 65.

The grooved plate 23 is a resin plate that serves as a flow path grooved plate in this embodiment, and that is formed with the flow path grooves 57 as the convergent flow paths 65. The flow path grooves 57 each having a closed bottom and an upper open face, are provided equal in number to the ink chambers 52 in the ink cartridge 5. In this embodiment, six flow path grooves 57 are formed linearly from the inlet ends, which are located below the corresponding upstream side through holes 59, to the outlet ends that are located above the inlet ports 38*a* of the recording head 3.

As is shown in FIG. 7, downstream side through holes 61 communicate with the outlet ends of the flow path grooves 57, and penetrate the grooved plate 23 in the direction of the thickness. The downstream through hole 61 constitutes a part of a second communication path in this embodiment.

Ribs for ultrasonic welding are formed around the flow path grooves 57. Further, positioning holes 62 are formed at the lateral ends of the grooved plate 23 and penetrate the grooved plate 23 in the direction of the thickness.

As is shown in FIG. 7, the base plate 45 and the grooved plate 23 are laminated and joined together, so that a plate-shaped convergent flow path unit 66 is constituted wherein the convergent flow paths 65 extend in the plate direction (horizontally). The convergent flow paths 65 are formed by using the lower face of the base plate 45 to seal the upper faces of the flow path grooves 57. As is shown in FIG. 8, the convergent flow paths 65 are arranged in a convergent manner from the needle connectors 49 of the ink cartridge 5 to the inlet ports 38*a* of the recording head 3 along the face of the grooved plate. That is, a pitch between downstream ends of adjacent convergent flow paths 65 is smaller than a pitch between upstream ends of the adjacent convergent flow paths 65. In this embodiment, the adjacent convergent flow paths 65 is gradually closer to each other from the upstream ends to the downstream ends.

As is described above in the present embodiment, the flow path grooves 57 are formed in the grooved plate 23, which is one of the constituent members of the convergent flow path unit 66, and the openings of the flow path grooves 57 are sealed with the base plate 45, which is the other member. Thus, the convergent flow paths 65 are formed merely by laminating and joining the plate members. Therefore, the individual parts, which have simple shapes, can be easily provided without a special manufacturing method. Further, metal dies can be manufactured at a low cost.

Since the convergent flow paths 65 are formed to extend in the face direction of the plate member, i.e., horizontally, differences in height between the upstream sides and the downstream sides of the convergent flow paths 65 can be reduced. This design contributes to the reduction of water head differences between the inlets and the outlets of the ink flow paths. And as a result, a defective operation, in which the ejection of droplets is rendered unstable due to the water head difference, can be eliminated, and the ink ejection performance can be made stable.

It is preferable to set a cross-sectional area of the convergent flow path 65 as small as possible within a range in which flow path resistance is not increased more than is necessary. This is because the flow rate of the ink can be increased during the cleaning process, for forcibly sucking ink from the nozzle openings 31, and air bubbles entering the convergent flow paths 65 are more completely sucked out and removed.

The downstream side through hole 61 constitutes an upstream portion of a second communication path in this embodiment, and are positioned opposite a corresponding filter 56. The downstream side through hole 61 communicates the downstream end of the convergent flow path 65 with the filter 56. In this embodiment, the downstream side through holes 61 are each substantially tapered, so that they gradually widen as they are closer to the downstream end, i.e., as they approach the filters 56. This design is purposed to obtain a large effective area for the filters 56, which in this embodiment are formed of fine metal meshes, and to prevent the stay of air bubbles.

The filter attachment panel 24 is a member located between the head case 26 of the recording head 3 and the convergent flow path unit 66, and includes filter holders 67, for holding the fine metal mesh filters 56, and holes 68, below the filters, that communicate with the filter holders 67. The holes 68 constitute parts of the second communication paths extending to the inlet ports 38*a*, and penetrate the filter attachment panel 24 in the direction of the thickness. That is, the series of flow paths extending from the inner spaces 60, of the ink supply ports 48, to the filter holes 68 are ink flow paths.

The filters 56 are securely fixed in a state that they are fitted to corresponding filter holders 67. In other words, each filter 56 is secured to the upstream end of the corresponding hole 68. The hole 68 is of a funnel shaped through hole that tapers as it approaches the inlet port 38*a* of the head case 26.

That is, in this embodiment, the filter 56 is located at an intermediate part of the second communication path that communicates the convergent flow path 65 and the recording head 3. Further, a part of the second communication path upstream of the filter 56 is increased in diameter toward the filter 56, and a part of the second communication path downstream of the filter 56 (i.e., in the recording head 3 side) is decreased in diameter toward the downstream side. With this arrangement, a large effective area is obtained for the filter 56, the stay of air bubbles is prevented and further a smoother ink flow is obtained.

In this embodiment, the downstream side through holes 61 and the holes 68 are formed correspondingly in number to the six ink supply needles 48. Ultrasonic welding ribs are formed around the filter holes 68 on the upper face of the filter attachment panel 24.

The inlet ports 38*a* are formed upright in the upper face of the head case 26. In this embodiment, six inlet ports 38*a* are positioned at smaller intervals than intervals of the needle connectors 49 of the ink cartridge 5, i.e., are concentrated within a smaller area.

For the thus arranged head unit 4, the ink supply needles 48, the cartridge case 2, the grooved plate 23 and the filter attachment panel 24 are preliminarily assembled into a sub-unit, and the recording head 3, the head substrate 25 and a flexible cable 69 are attached to the sub-unit.

To attach the recording head 3 to the sub-unit, packing members 70 made of rubber or a resin are placed between the filter attachment panel 24 and the head case 26 to ensure the formation of a liquid-proof seal between the filter holes 68*a* and the inlet ports 38*a*.

To form the sub-unit, in this embodiment, ultrasonic welding is used to join the individual members, i.e., the ink supply needles 48, the cartridge case 2, the grooved plate 23 and the filter attachment panel 24.

By employing ultrasonic welding for joining the members, the sealing of the juncture can be performed at the same time as the members are joined, and since after the joining, a drying process is not required, and thus the working efficiency is superior. Further since the members are welded and directly joined together by fusion, no foreign substance, such as an adhesive, is present, and the time-transient deterioration of the members rarely occurs. Further, since the ribs for ultrasonic welding are formed at the juncture, even plate members having rough surfaces can be welded comparatively easily.

However, the optimal amount of energy required for ultrasonic welding differs depending on the sizes of the members that are to be joined. The energy employed must be regulated, with a large amount being applied when comparatively large members are joined and a small amount being applied when comparatively small members are joined, because if excessive energy is applied, parts will be deformed or damaged, and if too little energy is applied, parts will be inadequately joined.

While taking the foregoing into account, in this embodiment, members are joined beginning with the largest member. That is, first, the base plate 45 of the cartridge case 2 is joined to the grooved plate 23 to form the convergent flow path unit 66. Then, the filter attachment panel 24 is joined to the lower face of the convergent flow path 66. And finally, the ink supply needles 48 are joined to the upper face of the convergent flow path 66 (i.e., the base plate 45).

By the process in this order, the amount of energy required for joining can be gradually reduced. Consequently, the deformation and damage of parts that were previously joined can be prevented.

In the thus arranged head unit 4, since the filter 56 is located in the second communication path, i.e. the terminal end of the ink flow path, the ink can be filtered immediately before it is supplied to the recording head 3. Thus, foreign substances that are present upstream of the filter 56 in the ink flow paths can be removed by the filter 56, and the entry of any foreign substances into the recording head 3 can surely be prevented. Further, since the portion of the ink flow path downstream of the filter 56 is quite short, foreign substances which may be attached to this portion can be remarkably reduced. Consequently, the time required for cleaning can be shortened, and manufacturing efficiency can be improved.

Furthermore, since the convergent flow path 65 is formed horizontally along the face of the convergent flow path unit 66, difference in height between the upstream side and the downstream side of the convergent flow path 65 can be reduced, and the water head difference between the inlet and the outlet of the ink flow path can also be reduced.

Therefore, an increase in water head difference can be prevented, even when the needle connector 49 (ink outlet) in the ink cartridge 5 and the inlet port 38*a* (ink inlet) in the recording head 3 are further separated along the face to increase the length of the ink flow path in connection with a case where the needle connectors 49 are widely separated by increasing the ink types contained in the ink cartridge 5 or the capacities of the ink chambers 52 or the inlet ports 38*a* are concentrated in a smaller area by reducing the size of the recording head 3. As a result, the ejection of ink droplets from the recording head 3 can be stabilized.

Also, the height may differ between the inlet and the outlet of each convergent flow path 65, so long as the difference does not greatly affect the water head difference.

In the first embodiment, the ink supply needles 48 and the base plate 45 are separate members, and the individual members are joined by ultrasonic welding to form the sub-unit. However, this invention is not limited to this arrangement, and the ink supply needles 48 and the base plate 45 may be integrally formed. A second embodiment for which this arrangement is employed will now be explained.

Figure 9:
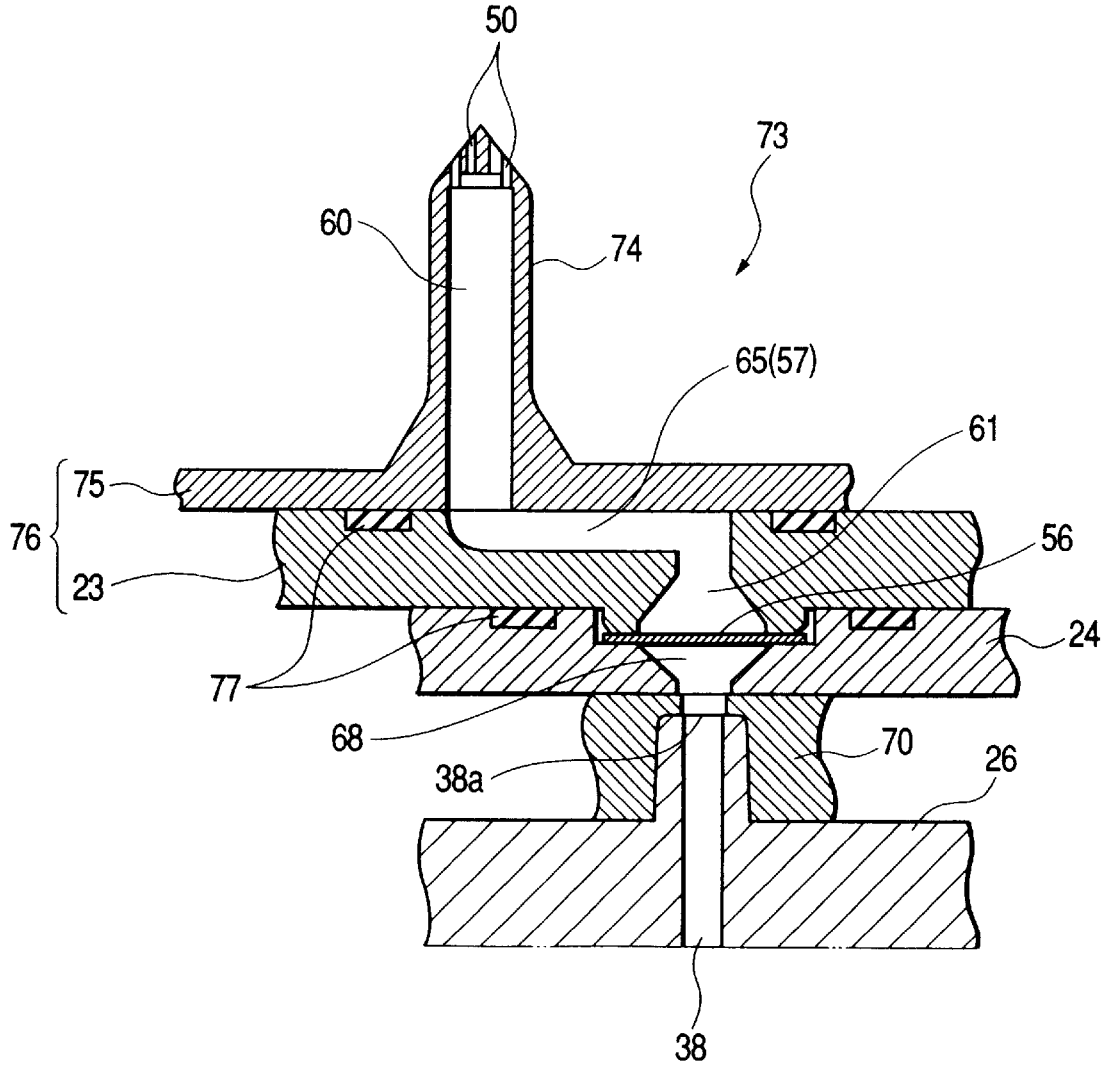
FIG. 9 is a cross-sectional view of the structure of a head unit according to a second embodiment of the invention.

FIG. 9 is a cross-sectional view of the structure of a head unit 73 according to the second embodiment. As is shown in FIG. 9, in this embodiment, ink supply needles 74 are integrally molded simultaneously with a base plate 75 of a cartridge case 2. Since the ink supply needles 74 are integrally formed with the base plate 75, which is one of the constituent members of a convergent flow path unit 76, the number of parts and the number of assembly steps can be reduced. With this arrangement, the first communication path in this embodiment is formed by the internal space 60 in the ink supply needle 74.

In addition, in this embodiment, the base plate 75 and the grooved plate 23, and the convergent flow path unit 76 and the filter attachment panel 24, are bonded by a liquid adhesive that flows easily. When the liquid adhesive is employed to bond the members, no energy is externally exerted during the bonding, so that the parts can be joined without being damaged. Also, a special device is not required for the bonding.

Further, in this embodiment, recessed portions 77, for receiving excess adhesive, are formed around the outer peripheries of the flow path grooves 57 and the holes 68. Since excess adhesive can be accumulated in the recessed portions 77, the adhesive can be prevented from overflowing and entering the ink flow paths. Therefore, a defective operation, wherein adhesive enters an ink flow path, hardens and forms a protrusion on which air bubbles in the ink flow path are caught, can be prevented, and ink can be efficiently supplied.

It should be noted that the adhesive used in this embodiment and in the other embodiments is not limited to a liquid adhesive, and may be a sheet adhesive, a gel adhesive, or a paste adhesive. Further, various adhesive materials can be employed, such as a thermoplastic resin adhesive, containing as a main component a silicon resin, an acrylic resin or a vinyl resin, a thermosetting resin adhesive, containing as a main component a phenol resin or an epoxy resin, or a rubber adhesive, containing as a main component natural rubber or synthetic rubber.

In this embodiment, since the filters 56 are also provided at the final stages of the ink flow paths, the entry of any foreign substances into the recording head can be prevented. In addition, the time required for cleaning can be reduced, and the manufacturing efficiency can also be improved.

Since the convergent flow paths 65 are formed horizontally, i.e. in the plate direction, an increase in the water head difference can be prevented, even when the lengths of the ink flow paths are increased in association with the case where the size of the ink cartridge 5 is increased due to the increased ink types or ink volumes, or the size of the head unit 4 is reduced. Therefore, the ejection of ink droplets from the recording head 3 can be stabilized.

In the first and the second embodiments, the filter attachment panel 24 on which the filters 56 are arranged is prepared separately from the grooved plate 23, which functions as a flow path grooved plate, and the filter attachment panel 24 joined to the lower face of the grooved plate 23. This invention is not limited to this arrangement, and the second communication paths may be formed in the flow path grooved plate while the filter holders for holding the filters 56 may be formed at the upstream ends of the second communication paths. A third embodiment for which this arrangement is employed will now be described.

Figure 10:
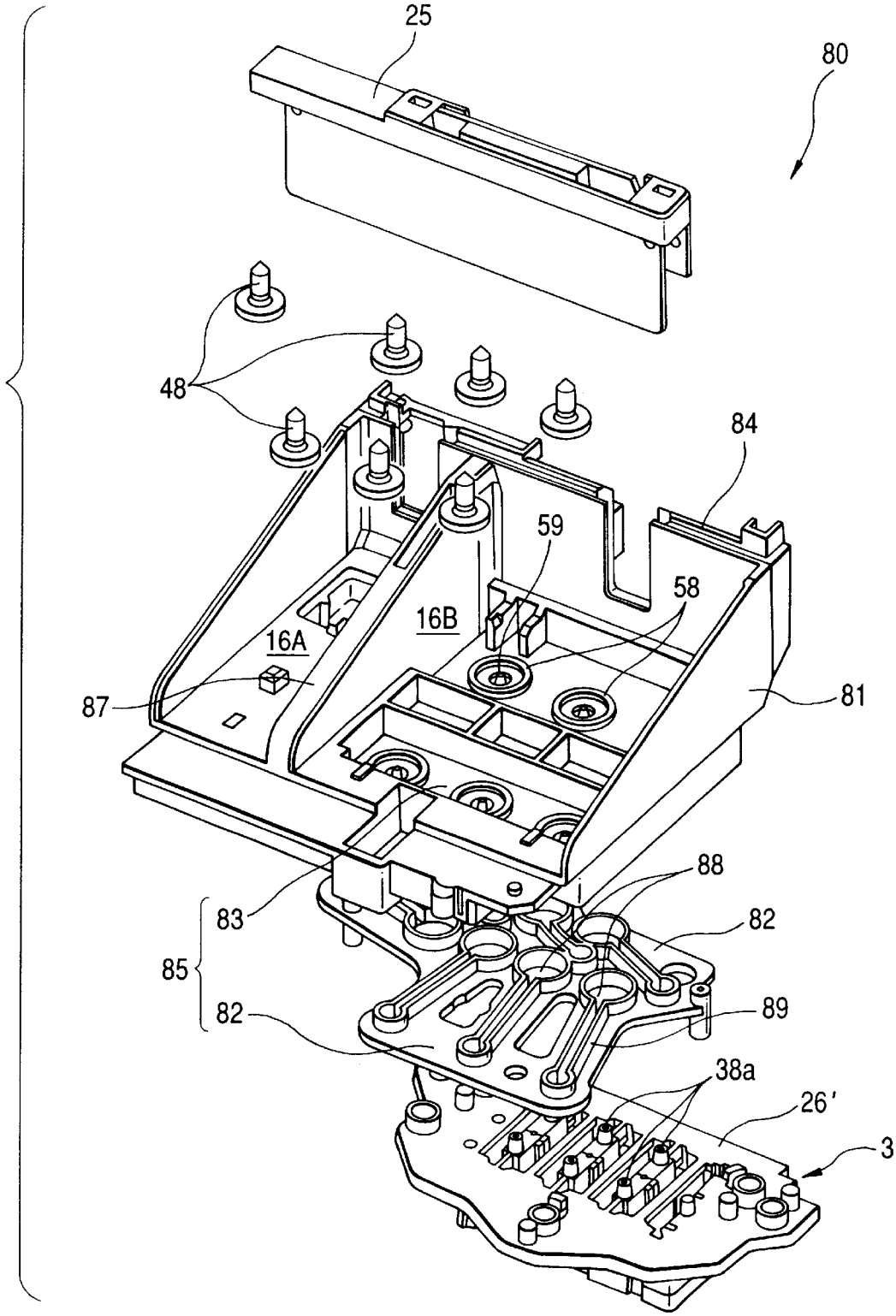
FIG. 10 is a upper exploded perspective view of a head unit according to a third embodiment.
Figure 11:
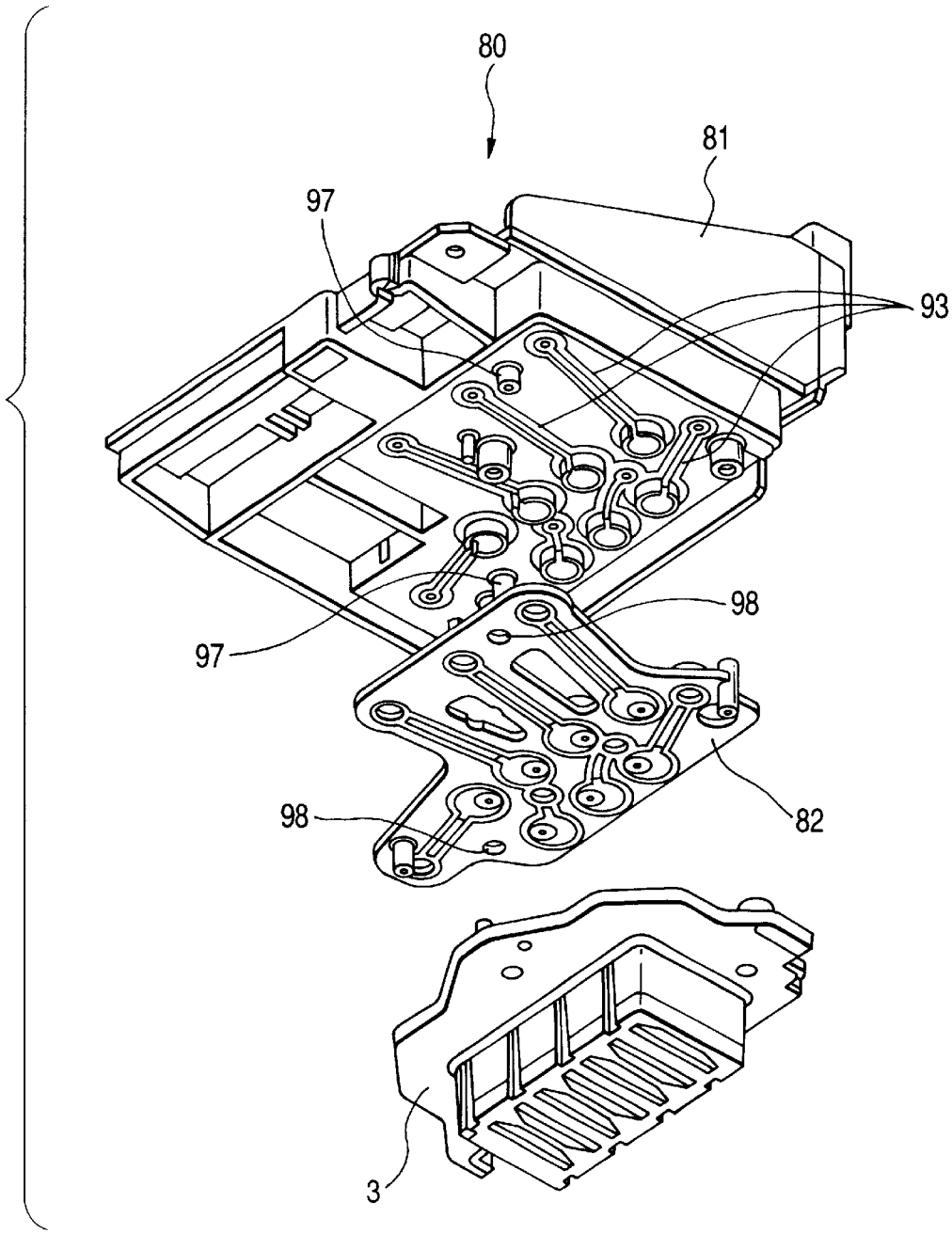
FIG. 11 is a bottom exploded perspective view of the head unit according to the third embodiment.

The difference between the third embodiment and the first and the second embodiments lies in the structure of the head unit, for which the following explanation is given. FIG. 10 is a top exploded perspective view of a head unit 80 in this embodiment, FIG. 11 is a bottom exploded perspective view of the head unit 80, and FIG. 12 is a cross-sectional view of the state wherein an ink cartridge 5 is mounted in a cartridge chamber.

Figure 12:
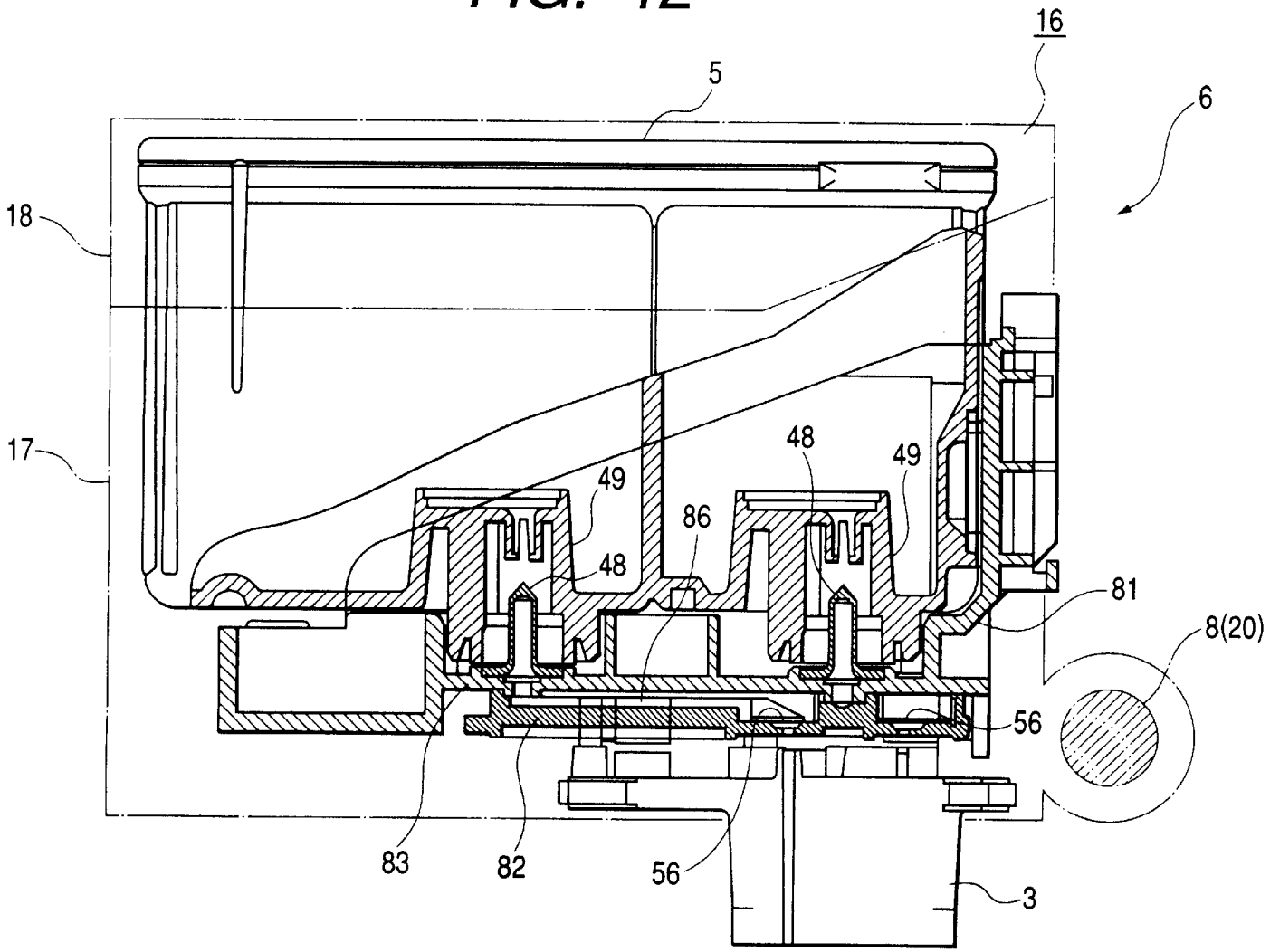
FIG. 12 is a cross-sectional view of the state wherein an ink cartridge is mounted according to the third embodiment.

As is shown in FIG. 12, a cartridge chamber 16, which has an upper portion that can be opened and closed, is integrally formed in a carriage 6 and the ink cartridge 5 is replaceably accommodated in the cartridge chamber 16. The head unit 80 is attached to the carriage 6.

The head unit 80 comprises a recording head 3, a cartridge case 81 and a grooved plate 82.

The recording head 3 has the same structure as those in the first and the second embodiments, and has piezoelectric vibrators 29 of a vertical vibration mode.

A cartridge case 81 is formed of a frame member having a base plate 83 and a substrate attachment unit 84. In this embodiment, also, the base plate 83 functions as a lid plate of this invention, and constitutes a plate-shaped convergent flow path unit 85, together with a grooved plate 82 that functions as a flow path grooved plate. Inside the convergent flow path unit 85, a plurality of flow paths 86 (see FIG. 13) constituting a part of the ink flow paths are arranged horizontally, i.e., along the plate face.

A plurality of hollow ink supply needles 48, corresponding in the number to ink colors, are joined upright on the upper face of the base plate 83. As is shown in FIG. 10, seven ink supply needles 48 are provided on the upper face of the base 83. Specifically, a single-color ink cartridge is mounted in a single-color cartridge camber 16A that is located to the left of a partition frame 87, and a multiple-color ink cartridge is mounted in a multiple-color cartridge chamber 16B that is located to the right of the partition frame 87. In this embodiment, the single-color ink cartridge is a black ink cartridge, and the multiple-color ink cartridge is a color cartridge containing six ink colors.

Each of these ink cartridges has substantially the same structure as the ink cartridge 5 (see FIG. 5) in the first embodiment.

Specifically, the black ink cartridge is mainly constructed by: a case main body, wherein an ink chamber in which an ink absorption member is stored is internally provided; and a flat case lid, that covers the upper opening of the case main body. Black ink is absorbed by and held in the ink absorption member stored in the ink chamber.

The color ink cartridge is mainly constructed, for example, by: a hollow box-shaped case main body, which is divided into two sections longitudinally and into three sections laterally to define total six ink chambers; six ink absorption members, which are stored in corresponding ink chambers and that absorb and hold ink of corresponding type of ink; and a flat case lid, which covers the upper opening of the case main body. Further, needle connectors 49 (see FIG. 12) are formed at the bottoms of the ink chambers of the case main body. Six ink colors, cyan, magenta, yellow, light cyan, light magenta and dark yellow, are absorbed and held by the ink absorption members stored in the ink chambers, respectively.

The grooved plate 82 is joined to the lower face of the base plate 83, and the recording head 3 is attached to the lower face of the grooved plate 82. Ink from the ink chambers is supplied to the recording head 3 along corresponding ink flow paths. In addition, the head plate 25 having an electronic circuit for driving the recording head 3 is mounted to the rear wall of the cartridge case 81, and a flexible cable 69 is connected to the connector of the head plate 25.

Figure 13A:
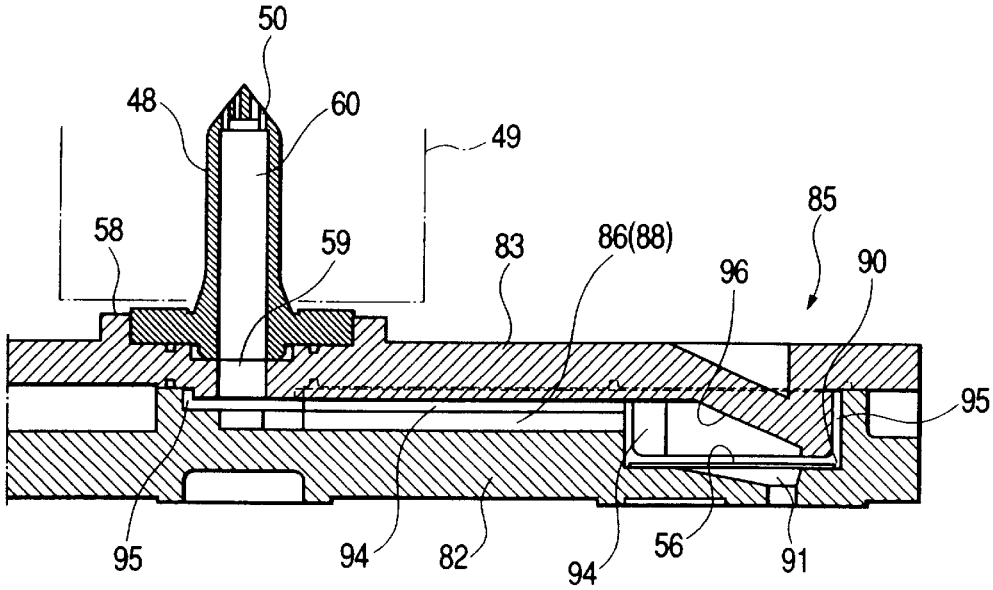
FIGS. 13A to 13B are diagrams for explaining the structure of a convergent flow path unit according to the third embodiment, i.e.
Figure 13B:
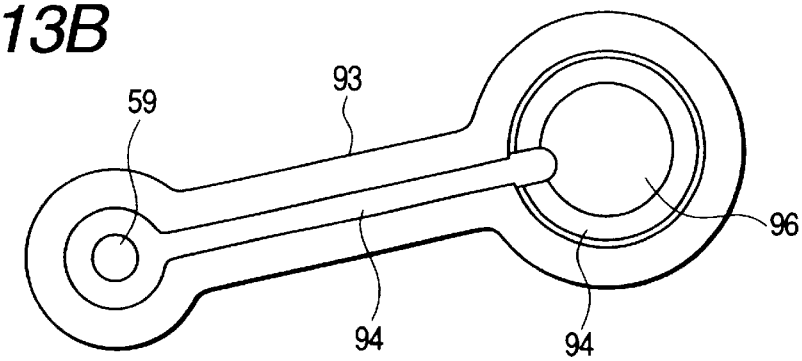
Figure 13C:
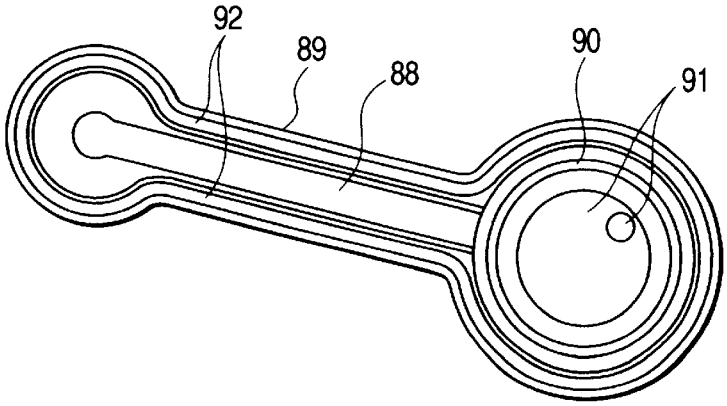
FIG. 13C is a plan view of the grooved plate.
Figure 14A:
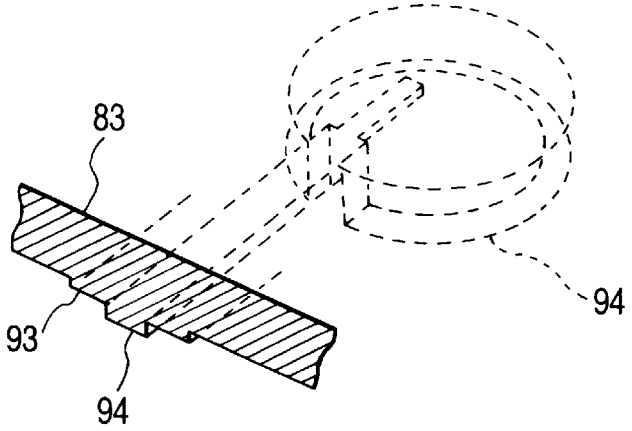
FIGS. 14A to 14C are diagrams for explaining the structure of the convergent flow path unit according to the third embodiment, i.e.

The convergent flowpath unit 85 will now be explained. FIG. 13A is a side cross-sectional view of the structure of the convergent flow path unit 85, FIG. 13B is a bottom view of the base plate 83, and FIG. 13C is a plan view of the grooved plate 82. FIG. 14A is a diagram for explaining the base plate 83 in the convergent flow path 86, FIG. 14B is a diagram showing the grooved plate 82, and FIG. 14C is a cross-sectional view of the state wherein the base plate 83 and the grooved plate 82 are bonded together.

As is shown in FIG. 13A, the head unit 80 has a plurality of ink flow paths that respectively extend from the inner spaces 60 of the ink supply needles 48, via the convergent flow paths 86, to the inlet ports 38*a* (see FIG. 10) of the recording head 3.

Upstream side through holes 59 are formed in the centers of bases 58, which are provided on the upper face of the base plate 83, and penetrate the base plate 83 in the direction of its thickness. The upstream side through holes 59 communicate with the inner spaces 60 of the ink supply needles 48 attached to the bases 58. That is, the upstream side through hole 59, together with the inner space 60 of the ink supply needle 48, constitutes the first communication path. The structure of the lower face of the base plate 83 will be described later.

Figure 14B:
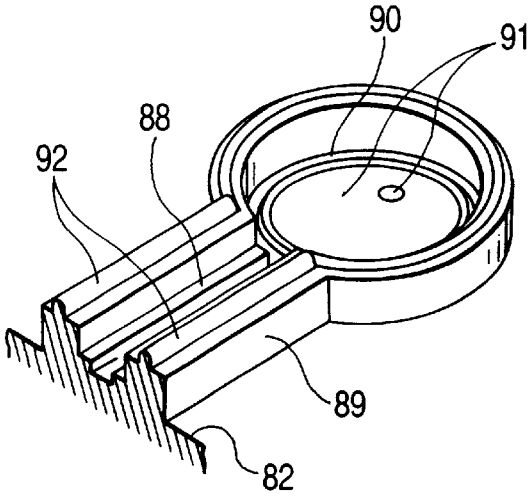
Figure 14C:
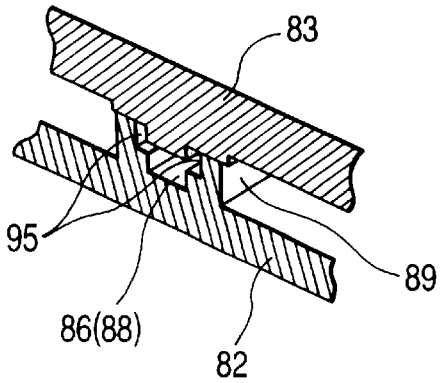

As is shown in FIGS. 12, 13C and 14B, the grooved plate 82 is a member made of a resin, which defines a plurality of flow path grooves 88, i.e. parts of the convergent flow paths, by upright walls 89. The flow path grooves 88, each having a bottom and an open upper face, are formed correspondingly in number to the ink chambers in the ink cartridge 5. In this embodiment, since seven ink chambers are formed in the ink cartridge 5, seven corresponding flow path grooves 88 are formed. That is, the flow path grooves 88 are formed linearly or curved along the plate from the inlet ends, which are located below the corresponding upstream side through holes 59, to the filter holders 90 that hold the filters 56.

Further, in the bottom of each filter holder 90, a hole 91 penetrates the grooved plate 82 in the direction of its thickness. The hole 91, located below the filter 56, serves as the second communication path in this embodiment, and communicates with the inlet port 38*a* of the recording head 3. That is, with this arrangement, the second communication portion is integrally formed in the flow path groove plate, and the filter holder is located at the upstream end of each second communication portion.

Ribs 92 for ultrasonic welding are formed at the distal ends of the upright walls 89 that define the flow path grooves 88 and the filter holders 90. The ribs 92 are formed as continuous protrusions, like a box wrench, and are used to join the base plate 83 to the grooved plate 82.

As is shown in FIGS. 11, 13B and 14A, on the lower face of the base plate 83, a plurality of linear or curved sealing portions 93, corresponding in number to the flow path grooves 88, are formed to close the upper openings of the flow path grooves 88. Protrusions 94, which are one size smaller than the openings of the corresponding flow path grooves 88 and are shorter in height than the depth of the corresponding flow path grooves 88, are formed on and protruded downward from the surface (lower face) of the sealing portions 93. When the protrusions 94 are fitted to the flow path grooves 88, the upper openings of the grooves 88 are closed by the sealing portions 93, respectively. As a result, as is shown in FIGS. 13A and 14C, gaps 95 are formed between the side walls of the protrusion 94 and the inner walls of the flow path grooves 88 to function as flash traps for accommodating flashes caused by ultrasonic welding. Similarly, such gaps 95 are also formed in the filter holders 90.

When the gaps 95 are formed as flash traps, and when flashes caused by welding are accommodated in the gaps 95, air bubbles flowing with ink are seldom caught by the flashes. Thus, a defective operation, wherein air bubbles interfere with the free flow of ink, can be prevented, and ink can be efficiently supplied.

The gaps 95 are also effective when an adhesive is used to bond the base plate 83 and the grooved plate 82. That is, when adhesive coats applied to the faces are too thick, the extra adhesive is held in the gaps 95, and a defective operation, wherein extra adhesive overflows and enters the convergent flow path 86, can be prevented, and air bubbles in the ink flow are seldom caught by the hardened, extra adhesive.

In the base plate 83, inclined walls 96 located above the filter holders 90 have circular shapes in plane, as is shown in FIG. 13B. As is shown in FIG. 13A, the walls 96 incline downward, so that ink introduced into the filter holders 90 is guided toward the filter holes 91, without the flow rate being reduced. That is, with the inclined walls 96, at these portions, as the convergent flow paths 86 descend their heights are reduced.

Further, at the peripheral portion of the base plate 83, as is shown in FIG. 11, two downward projecting, cylindrically shaped positioning protrusions 97 are formed, and at corresponding positions, two positioning holes 98 penetrate the grooved plate 82 in the direction of its thickness. Therefore, when the positioning protrusions 97 are fitted into the corresponding holes 98, the base plate 83 and the grooved plate 82 are aligned and laminated.

The laminated base plate 83 and grooved plate 82 are joined together by welding, so that the convergent flow paths 86 are formed at the boundary of the plates along the plane direction (horizontally).

As is described above, according to the embodiment, the flow path grooves 88 are formed in the grooved plate 82, which is one of the plate members of the convergent flow path unit 85, and the openings of the flow path grooves 88 are closed by the base plate 83, the other plate member. Therefore, the convergent flow paths 86 can be formed merely by laminating and joining the plate members, and the individual parts that are employed can have simple shapes.

Figure 15:
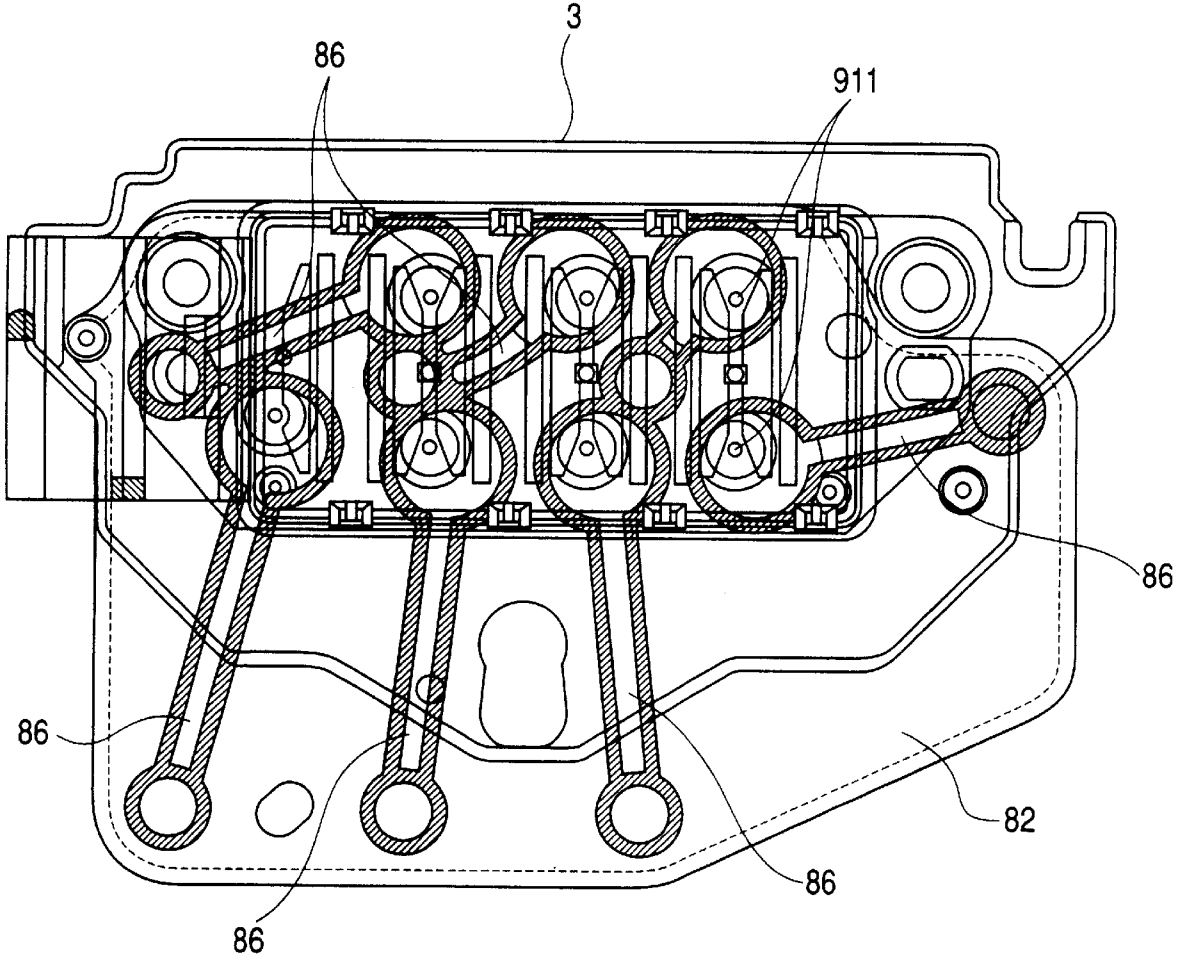
FIG. 15 is a schematic diagram showing the convergent flow path unit according to the third embodiment.

One end of each convergent flow path 86 communicates with the inner space 60 in one of the ink supply needles 48 via one of the upstream side through holes 59, and the other end communicates with one of the filter holders 90. Further, the holes 91 below the filter communicate with the inlet ports 38*a* of the recording head 3. Therefore, as is shown in FIG. 15, the individual convergent flow paths 86 converge from the needle connectors 49 of the ink cartridge 5 to the inlet ports 38*a* of the recording head 3. Thus, ink can be supplied to the recording head 3 even in a small, limited area. And as a result, the supply of ink is not affected by a reduction in the size of the recording head 3.

Since the convergent flow paths 86 are formed horizontally, i.e., along the plane of the plate member, the difference in height between the upstream side and the downstream side of the convergent flow path 86 can be reduced. And accordingly, the water head difference between the inlet and the outlet of the ink flow path can also be reduced.

A filter holder 90 is located at the border of the flow path groove 88 and the hole 91 that together constitute the convergent flow path 86. The filter 56, composed of a fine metal mesh, is located inside the filter holder 90. The filter S6, which is fixed to the upper face of the grooved plate 32 by welding, is used to filter out foreign substances in ink. The upstream portion of the hole 91 is a funnel shaped inclined hole that tapers as it descends, so that the effective area of the filter 56 is increased and the ink flows smoothly. In this embodiment, seven holes 91 are formed to correspond to the seven ink supply needles 48.

Furthermore, the similarly to previous embodiments, the piezoelectric vibrator units 28 are stored in the recording head 3, as is shown in FIG. 10 (see also FIG. 4), and the flow path unit 27 is joined to the lower face of a head case 26'. The head case 26' is a block member where a flange is provided as an attachment portion at the upper end, and is molded of a thermosetting resin, such as an epoxy resin. In addition, a plurality of cylindrical positioning tubes are formed around the upper face of the flange, and cylindrical positioning tubes provided to the cartridge case 81 are inserted into these tubes.

As is described above, the cylindrical inlet ports 38*a*, which are used as the ink inlets for the recording head 3, are formed upright in the central portion of the upper face of the head case 26'. In this embodiment, seven inlet ports 38*a* are arranged at the locations where they can communicate with the respective holes 91 i.e. the outlet sides of the corresponding ink flow paths.

For the thus arranged head unit 80, the ink supply needles 48, the cartridge case 81 and the grooved plate 82 are preliminarily assembled to form a sub-unit. The recording head 3 and the head substrate 25 are attached to the sub-unit. To attach the recording head 3 to the sub-unit, a packing (not shown) made of rubber or a resin is placed between the grooved plate 82 and the head case 261 so as to provide a liquid-proof seal between the holes 91 and the corresponding inlet ports 38*a*.

To form the sub-unit, in this embodiment, the individual members, i.e., the ink supply needles 48, the cartridge case 81 and the grooved plate 82, are joined together by welding. First, ultrasonic welding is used to join the base plate 83, of the cartridge case 81, to the grooved plate 82, and then, ultrasonic welding is used to join the ink supply needles 48 to the upper face of the-base plate 83.

In this case, since the convergent flow path unit 85 is formed of two plates, the base plate 83 and the grooved plate 82, the convergent flow path unit 85 can be obtained by performing only one ultrasonic welding process. Therefore, variances in the height of the convergent flow path unit 85 (i.e., the convergent flow paths 86) can be minimized, even when welding that tends to cause variances is employed.

Further, since the filter holders 90 (the filters 56) are located at the terminals of the ink flow paths and filter the ink immediately before it is supplied to the recording head 3, foreign substances in the ink flow paths upstream of the filters 56 can be removed by the filters 56. As a result, the entry of any foreign substances into the recording head 3 can be prevented.

In addition, since the convergent flow paths 86 are formed horizontally, differences in height between the upstream sides and the downstream sides of the ink flow paths can be reduced, and the water head difference between the inlets and outlets of the ink flow paths can also be reduced. Therefore, even when the needle connectors 49 (ink outlets) of the ink cartridge are widely separated along the plane direction from the inlet ports 38*a* (ink inlets) of the recording head 3, and the ink flow paths are extended, an increase in water head difference can be prevented. Therefore, the ejection of ink droplets by the recording head can be stabilized.

In the first to the third embodiments, the base plate 45 or 83 functions as the lid plate, and the grooved plate 23 or 82, which serves as the flow path groove plate, is joined to the base plate. However, the present invention is not limited to this arrangement. The flow path grooves may be formed in the base plate that serves as the flow path groove plate in this invention, and the openings of the flow path grooves may be closed by a member that serves as the cover plate in the invention.

A fourth embodiment for which this arrangement is employed will now be described. Since the difference between this embodiment and the other embodiments also lies in the structure of the head unit, the following explanation will be given for the head unit.

Figure 16:
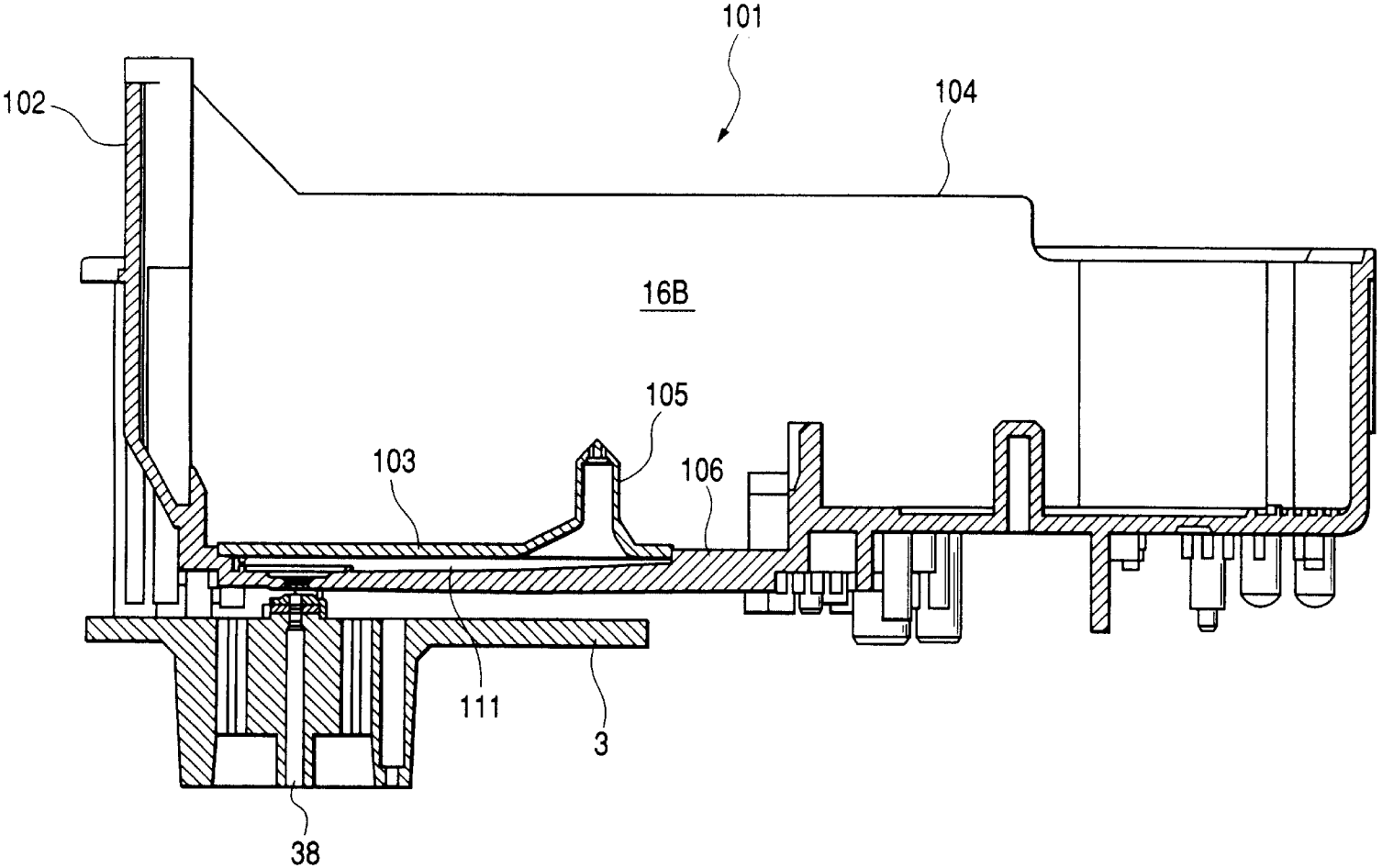
FIG. 16 is a cross-sectional view of a head unit according to a fourth embodiment.
Figure 17:
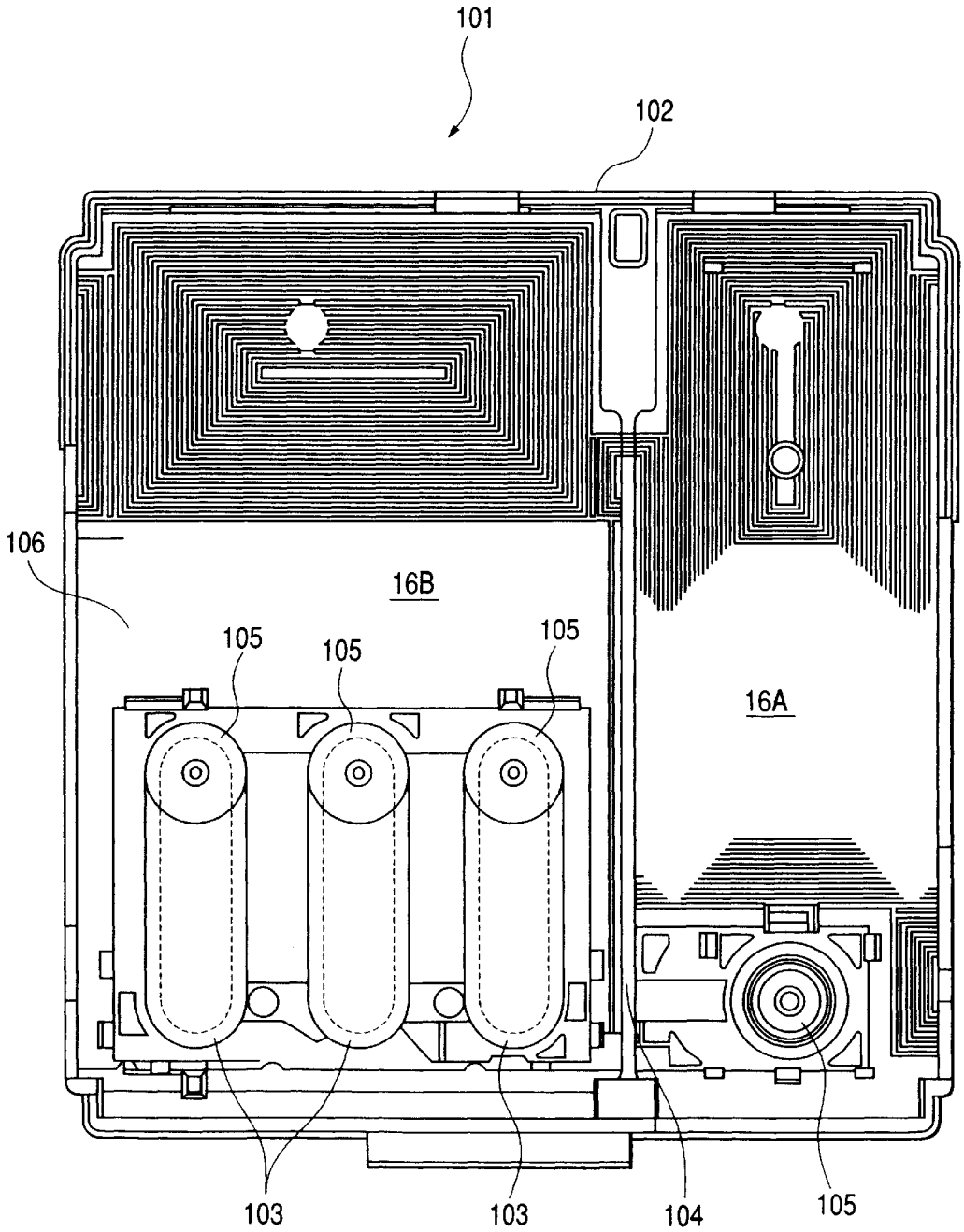
FIG. 17 is a plan view of the head unit according to the fourth embodiment.

As is shown in FIGS. 16 and 17, a head unit 101 in this embodiment comprises a cartridge case 102, cover members 103, which function as the lid plate in this embodiment, and a recording head 3.

In the cartridge case 102, an off center partition frame 104 is extended in the front and to the rear, and is internally divided into two chambers for storing ink cartridges 5. That is, in FIG. 17, a multiple-color cartridge chamber 16B is defined on the left of the partition frame 104, and a single-color cartridge chamber 16A is defined on the right of the partition frame 104. Three ink supply needles 105 are formed upright, in a row, on the bottom of the multiple-color cartridge chamber 16B, and one ink supply needle 105 is formed upright on the bottom of the single-color cartridge chamber 16A.

A color ink cartridge containing three ink colors, cyan, magenta and yellow, is mounted in the multiple-color cartridge chamber 16B, and an ink cartridge containing black ink is mounted in the single-color cartridge chamber 16A. The ink in the ink cartridges is introduced via the corresponding ink supply needles 105 to the recording head 3.

Figure 18:
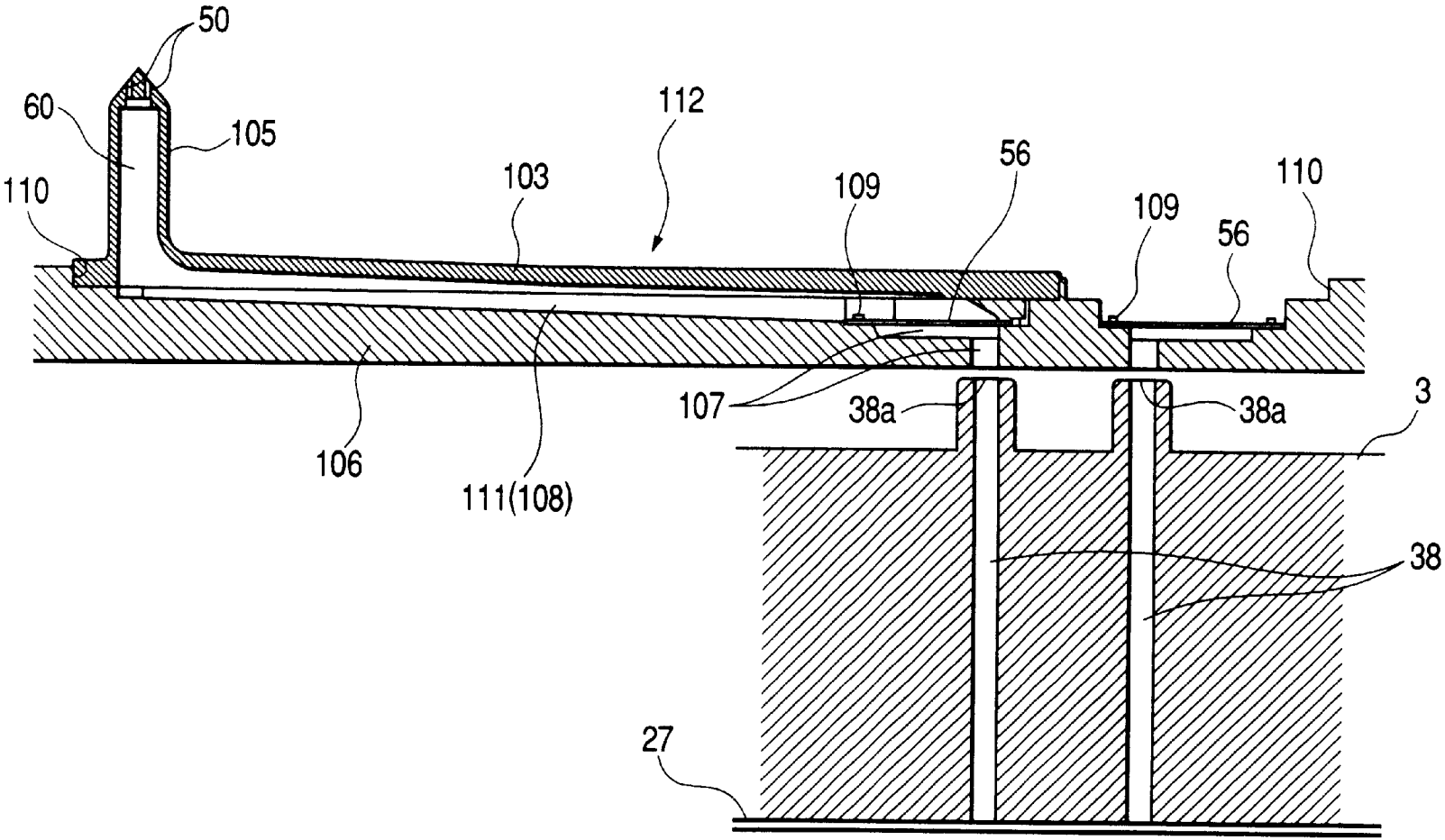
FIG. 18 is a cross-sectional view for explaining the structure of a convergent flow path unit according to the fourth embodiment.

As is shown in FIG. 18, the ink supply needle 105 is conically shaped at its distal end, similarly to the previous embodiments. Further, a plurality of ink introduction holes 50 are formed in the inclined face of the needle 105 to communicate the inner space 60, in the ink supply needle 105, to the outside.

In a base plate 106 (corresponding to the flow path grooved plate of this invention) that constitutes the bottom of the cartridge case 102, holes 107 below filters are formed at locations that are offset along the plane direction from the inner spaces 60 of the corresponding ink supply needles 105, and communicate with the inlet ports 38*a* at the recording head 3. The inner spaces 60 in the ink supply needles 105 function as the first communication paths in this embodiment, and the filter holes 107 function as the second communication paths in this embodiment.

In the base plate 106, flowpath grooves 108 are formed along the plate to extend from the lower portions of the inner spaces 60 in the ink supply needles 105 to the holes 107. Further, recessed filter holders 109 are formed at the borders of the flow path grooves 108 and the holes 107, and filters 56 are provided inside the filter holders 109. That is, the base plate 106 includes the flow path grooves 108, the holes 107 and the filter holder 109, and also functions as the filter holding plate for holding the filters 56.

Furthermore, steps 110 that are lower than the upper face of the base plate 106 are formed at the respective peripheral edges of the upper openings of the flow path grooves 108, and the lid members 103 are respectively fitted to the steps 110. When the lid member 103 is fitted to the step 110, the upper opening of the flow path groove 108 is closed by the lid member 103. Thus, the gap defined by the flow path grove 108 and the lid member 103 is used as a convergent flow path 111. That is, in this embodiment, a convergent flow path unit having a plate shape is provided by the base plate 106 and the lid members 103, and the ink supply needles 105 are integrally formed on the respective cover members 103.

In this head unit 101, each convergent flow path 111 inclines slightly from the ink supply needle 105 toward the filter 56. In other words, the path 111 slopes upward from the filter 56 to the ink supply needle 105. The inclination angle of the convergent flow path 111 is not specifically limited, and the convergent flow path 111 may be formed horizontally, or at a larger inclination angle.

When each convergent flow path 111 is formed horizontally, as is described above, the height of the head unit 101 can be reduced, so that the water head difference can be suppressed and the printer 1 can be compactly made. When each convergent flow path 111 is formed at an angle, the ink smoothly flows along the convergent flow path 111, and stay of air bubbles seldom occurs. Thus, ejection failures due to the stay of air bubbles can be prevented.

The method for attaching the lid members 103 in this head unit 101 is not especially limited, and various methods may be employed. Thermal welding, ultrasonic welding, or adhesive bonding can be preferably employed.

According to the thermal welding method, packing is sandwiched between the members to be joined, and holes are formed in one of the members, while mating protrusions are formed on the other member. After the protrusions are fitted into the holes, the two members are welded and are fixed by thermally melting the exposed protrusions. With this method, since the members can be joined only by melting a resin using a heating tool, such as a heat chip, a manufacturing apparatus can be simplified.

Since the recording head can be efficiently assembled using any method, productivity is enhanced and manufacturing cost can be reduced. Even when foreign substances or air bubbles enter the junctures, the filters 56 downstream of the junctures can completely remove the foreign substances or air bubbles and prevent them from entering the recording head 3.

In the fourth embodiment as well as in the other embodiments, ink passed through the filter 56 is immediately supplied to the recording head 3, so that foreign substances can be prevented from entering the ink that is supplied. Thus, when the convergent flow path 111 is formed by joining the cartridge case 102 and the lid members 103, foreign substances that entered during the joining process can be completely removed. Therefore, the degree of freedom for the design and the process is increased, and productivity and the yield can be improved. Further, since each ink supply needle 105 (inner space 60) is shifted from the corresponding hole 107 along the plate, the ink supply needle 105 can be positioned without being affected by the opening pitches of the inlet ports 38*a* of the recording head 3. As a result, the effective area of the filter 56 can be increased, and foreign substances and air bubbles can be even more completely captured.

In this embodiment, since the convergent flow paths 111 are formed of the flow path grooves 108, which are opened toward the upper face of the base plate 106, and the lid members 103, which close the openings of the flow path grooves 108, the two members can be constituted by parts having comparatively simple shapes. In addition, since the lid members 103 are integrally formed with the ink supply needles 105, the required number of parts can be reduced, and the assembly costs can also be reduced.

Figure 19:
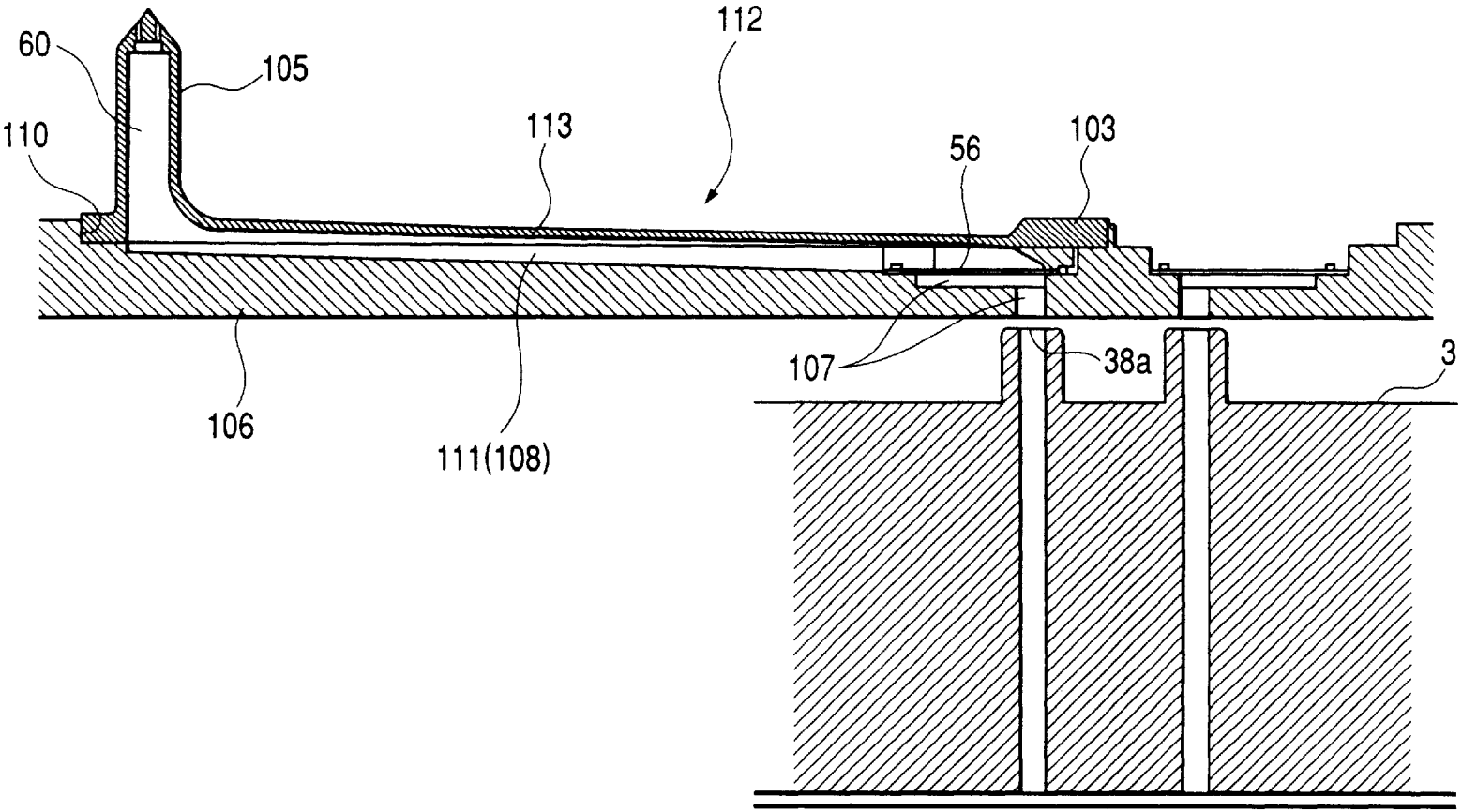
FIG. 19 is a cross-sectional view of a modification for the fourth embodiment for explaining the structure of the convergent flow path unit.

A modification of the fourth embodiment will now be described. As the feature of this modification, as is shown in FIG. 19, a flexible portion 113, which can be elastically deformed by the pressure change of ink flowing in the convergent flow path 111, is provided to each lid member 103 that functions as a lid plate.

That is, in this modification, the portion of the lid member 103 used to seal the flow path groove 108 is thinned so it can serve as the flexible portion 113 having elasticity. In this modification, the flexible portion 113 extends over the entire upper opening of the flow path groove 108; however, the flexible portion 13 may be formed partially above the upper opening.

The flexible portion 113 absorbs the pressure change of ink flowing in the convergent flow path 111. When the carriage 6 is moved in the main scanning direction, the ink cartridge 5 vibrates. And as the ink cartridge 5 vibrates, the pressure change may occur in ink flowing in the convergent flow path 111. And when the pressure change occurs in the ink flowing in the convergent flow path 111, the flexible portion 113 is deformed depending on the ink pressure to absorb the pressure change. Therefore, the pressure imposed on the ink flowing along the convergent flow path 111 can be maintained within a constant range, and the ejection of ink droplets can be stabilized.

The flexible portion 113 may be formed of a different member discrete from the lid member 103. In this case, an opening is formed through the lid member 103 to penetrate in the thickness direction thereof at the location corresponding to the area where the flow path groove 108 is sealed, and the opening is closed by the member that serves as the flexible portion 113. The material used for the flexible portion 113 is not especially limited so long as it is a flexible material, and thus, a variety of materials, such as rubber, a resin and a thin metal film, can be employed In the fourth embodiment and its modification, the ink supply needle 105 and the lid member 103 are formed as an integral member. The invention is not limited to this arrangement, however, and the ink supply needle 105 and the lid member 103 may be formed separately.

When air bubbles enter the recording head 3, the air bubbles hinders or stops the flow of ink. Therefore, it is preferable that the air bubbles be prevented from entering the series of flow paths that extend from the ink supply needles 105 via the convergent flow paths 111 to the recording head 3. But since the head unit 101 of this type uses the replaceable ink cartridge 5, the entry of air bubbles into the ink flow paths can not be avoided.

As a countermeasure for this problem, air bubble holding spaces may be formed in intermediate portions of the ink flow paths to hold air bubbles. A fifth embodiment for which this arrangement is employed will now be described.

Figure 20:
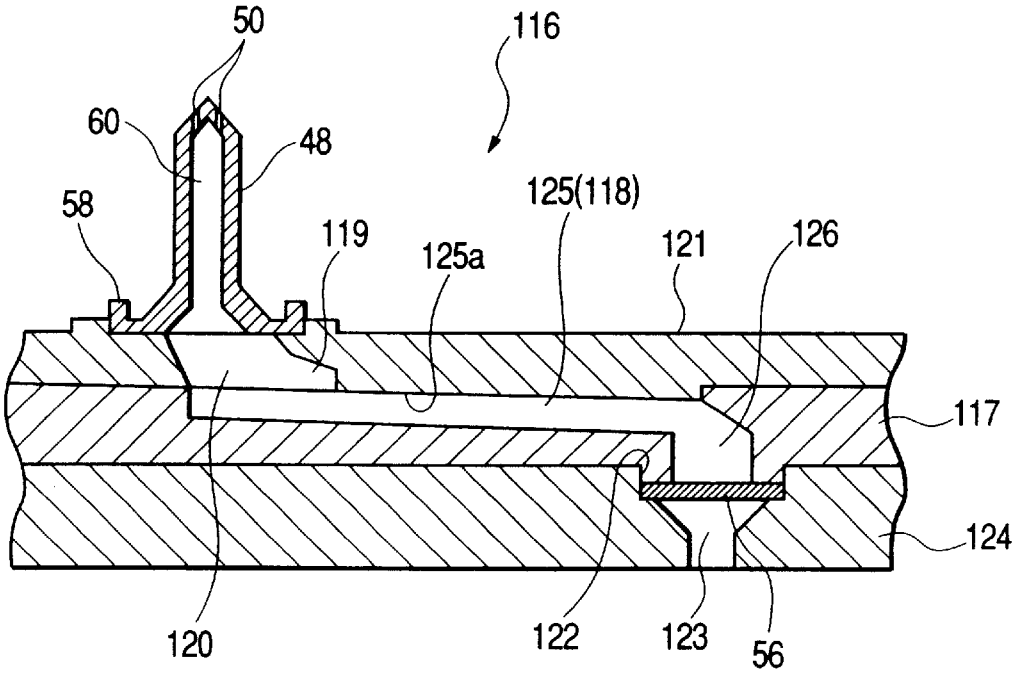
FIG. 20 is a partial, enlarged cross-sectional view of a convergent flow path unit for explaining the essential structure of a fifth embodiment.

FIG. 20 is a partially enlarged cross-sectional view of a plate shaped convergent flow path unit 116 used for explaining the essential structure according to the fifth embodiment. Since other arrangements in this embodiment are the same as those in the previous embodiments, no further explanation for them will be given.

A base plate 117 of a cartridge case 102 functions as the flow path groove plate in this embodiment, and a plurality of flow path grooves 108 with upper openings are formed that correspond to the ink flow paths. A lid member 121 (i.e. a lid plate in this embodiment) is joined to the upper face of the base plate 117, and through holes 120 that are used as first air bubble holding chambers 119 (corresponding to the first air bubble holding spaces in this embodiment) are formed through the lid member 121. A filter attachment panel 124 is joined to the lower face of the base plate 117, and filter holders 122, for holding filters 56, and holes 123 below the filters 56 are formed in the filter attachment panel 124. A plurality of bases 58 for joining ink supply needles 48 thereto are formed on the upper face of the lid member 121.

When the base plate 117, the lid member 121, the filter attachment panel 124 and the ink supply needles 48 are joined together, the openings of the flow path grooves 118 are closed by the lid member 121, so that convergent flow paths 125 are formed. Further, a series of ink flow paths are defined, each being constructed by the inner space 60 of the ink supply needle 48, the through hole 120, the convergent flow path 125 and the hole 123 communicated together.

With this arrangement, the convergent flow path unit 116 is constituted by the base plate 117 and the lid member 121.

The through holes 120 formed through the lid member 121 respectively communicate the inner spaces 60 of the ink supply needles 48 and the convergent flow paths 125. That is, the through hole 120 in combination with the inner space 60 of the ink supply needle 48 constitutes the first communication paths in this embodiment. The lower half portion of each through hole 120 is expanded and becomes larger in diameter as it descends, and the expanded lower half portion functions as a first air bubble holding chamber 119 in which air bubbles that enter the ink flow path are held.

The portion of the base plate 117 close to and upstream of the filter 56 is also expanded so it is larger in diameter than the other portions thereof and forms a predetermined space. This space is defined as a second air bubble holding chamber 126, which is a second air bubble holding space in this embodiment.

The second air bubble holding chamber 126 is used to hold air bubbles captured by the filter 56, and also constitutes the second communication path in this embodiment, together with the hole 123.

In this embodiment, the volume of the first air bubble holding chamber 119 is greater than the volume of the second air bubble holding chamber 126.

When the volumes are set in this manner, comparatively small air bubbles captured by the filter 56 can be held in the second air bubble holding chamber 126. Large air bubbles that may remain in the convergent flow path 125, even after suction is applied in the cleansing process, can be held in the first air bubble holding chamber 119 which has a large volume and is located separate from the recording head 3. As a result, the entry of air bubbles into the recording head 3 can be more effectively prevented. Since the volume of the second air bubble holding chamber 126 above the filter 56 can be comparatively small, the height from the filter 56 to the convergent flow path 125 can be reduced. Therefore, the size of the head unit can be reduced, and even a recording head having a comparatively large height can be easily mounted.

In this embodiment, for the convergent flow path 125, an inclined ceiling face 125*a* rises slightly from the filter holder 123 side to the through hole 120 side. This arrangement causes air bubbles in the convergent flow path 125 to float along the ceiling 125*a* of the convergent flow path 125, thereby easily transfer the air bubbles to the first air bubble holding chamber 119.

The method used for joining the members of the convergent flow unit 126 is not particularly limited, and various methods can be employed. As is described above, adhesive bonding, thermal welding or ultrasonic welding is preferably employed.

In this embodiment, since the filter 56 is located at the upstream end of the hole 123, ink passed through the filter 56 is immediately supplied to the recording head 3. Thus, the entry of any foreign substance into ink after the ink has passed through the filter 56 can be prevented.

Since the first air bubble holding chamber 119 can be located upstream of the convergent flow path 125, the entry of air bubbles into the recording head can be surely prevented. Further, since the convergent flowpath unit 116 is formed of simple plate members, such as the base plate 117 and the lid member 121, the metal dies can be easily manufactured, and manufacturing costs can be reduced.

Figure 21:
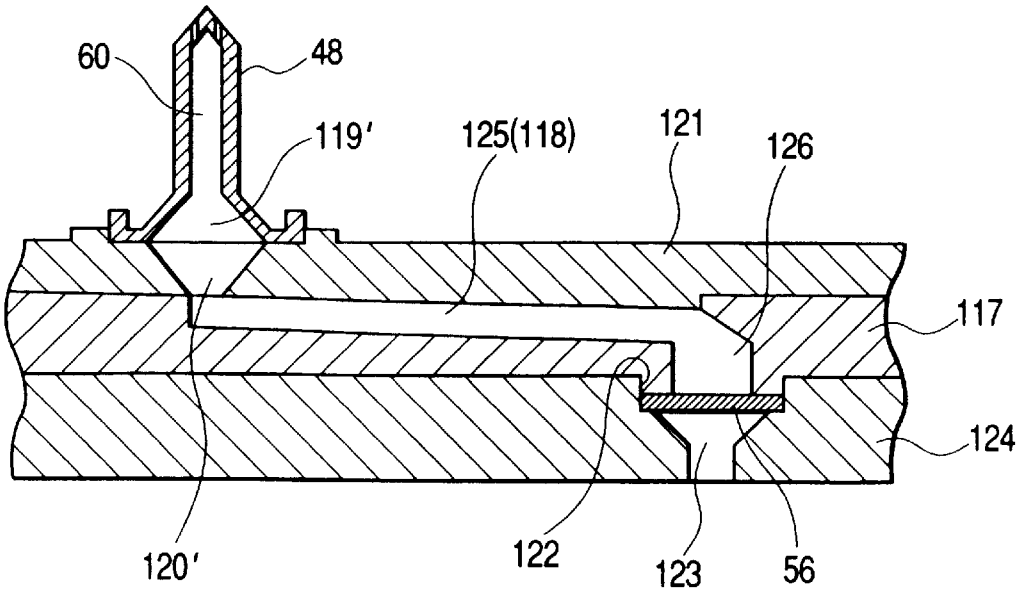
FIG. 21 is a partial, enlarged cross-sectional view of a convergent flow path unit for explaining the essential structure for a modification for a fifth embodiment.

A modification of the fifth embodiment will now be explained. In this modification, as is shown in FIG. 21, a first air bubble holding chamber 119' is formed at the foot of the ink supply needle 48. That is, the ink supply needle 48 that constitutes one part of the first communication path in this embodiment is designed such that the foot of the inner space 60 is expanded in diameter as it descends to define the first air bubble holding chamber 119'. In FIG. 21, a through hole 120' is also formed.

The same effects as those obtained in the fifth embodiment are also obtained with this modification. Further, with this modification, since the air bubble holding chamber 119' is formed at the foot of the ink supply needle 48, air bubbles captured in the first air bubble holding chamber 119' rarely move toward the convergent flow path 125. Thus, the entry of all air bubbles into the recording head 3 can be more positively prevented.

The invention is not limited to the structure of each embodiment, and can be variously modified without departing from the scope of the invention.

Figure 22:
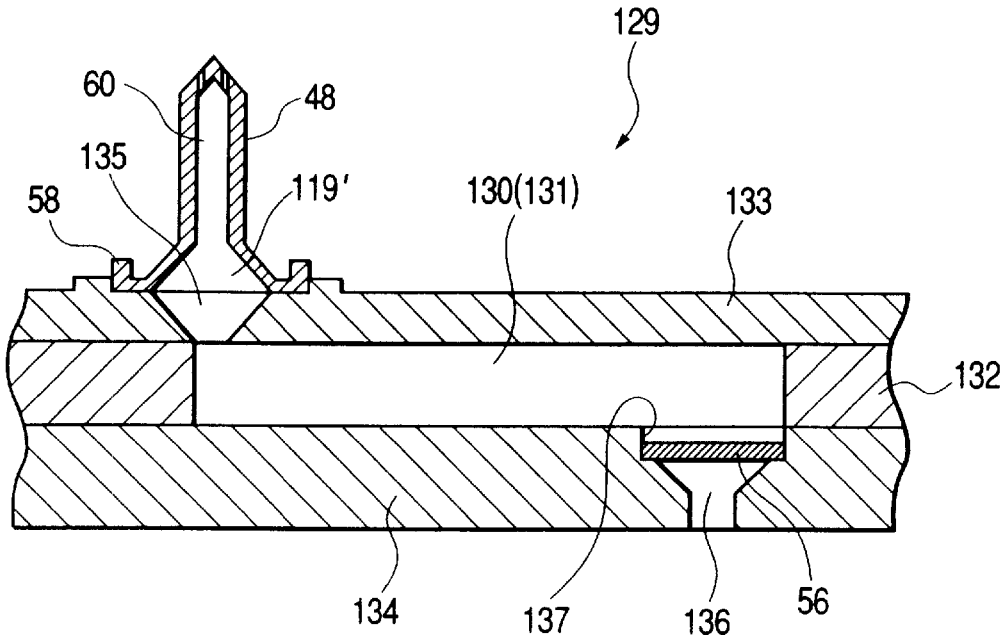
FIG. 22 is a partial, enlarged cross-sectional view of a convergent flow path unit for explaining a modification of the convergent flow path unit that is constituted by an opening substrate, an upper cover member and a lower cover member.

As is shown in FIG. 22, a convergent plate-shaped flow path unit 129 may be constituted by an opening substrate 132 having openings 131, each serving as a convergent flow path 130 penetrating therethrough in the direction of the thickness, an upper lid member 133 for closing the upper opening sides of the openings 131, and a lower lid member 134 for closing the lower opening side of the openings 131.

In this example, the upper lid member 133 is formed with bases 58, to which the respective ink supply needles 48 are attached, and through holes 135, for connecting the inner spaces 60 of the ink supply needles 48 to the convergent flow paths 130, respectively. Further, the lower lid member 134 is formed with holes 136, for respectively communicating the openings 131 with the inlet ports 38*a* of the recording head 3, and filter holders 137, each of which is located at the upstream end of the hole 136 to hold the filter 56.

With this arrangement, the opening substrate 132 can be obtained merely by forming the openings 131 in a flat plate, so that the processing is very easy. Further, the upper lid member 133 can be obtained merely by forming the bases 58 and the through holes 135 in a flat plate, and the lower lid member 134 can be obtained by forming, in a flat plate, recessed portions that serve as the filter holders 137 and through holes that serves as the holes 136 below the filters 56. Thus, all the members can be processed easily.

Therefore, with this arrangement, the individual plate members of the convergent flow path unit 129 can be easily manufactured. In addition, since the plate members need only be laminated and bonded together to form the convergent flow path unit 129, the assembly process is easy. Thus, manufacturing efficiency can be improved, and manufacturing costs can be reduced.

With this arrangement, the opening substrate 132 corresponds to the opening plate in this embodiment, the upper lid member 133 corresponds to the upper lid plate in this embodiment, and the lower lid member 134 corresponds to the lower lid plate in this embodiment. The inner space 60 in the ink supply needle 48 and the through hole 135 function as the first communication path in this embodiment, and the hole 136 below the filter 56 functions as the second communication path in this embodiment.

Figure 23:
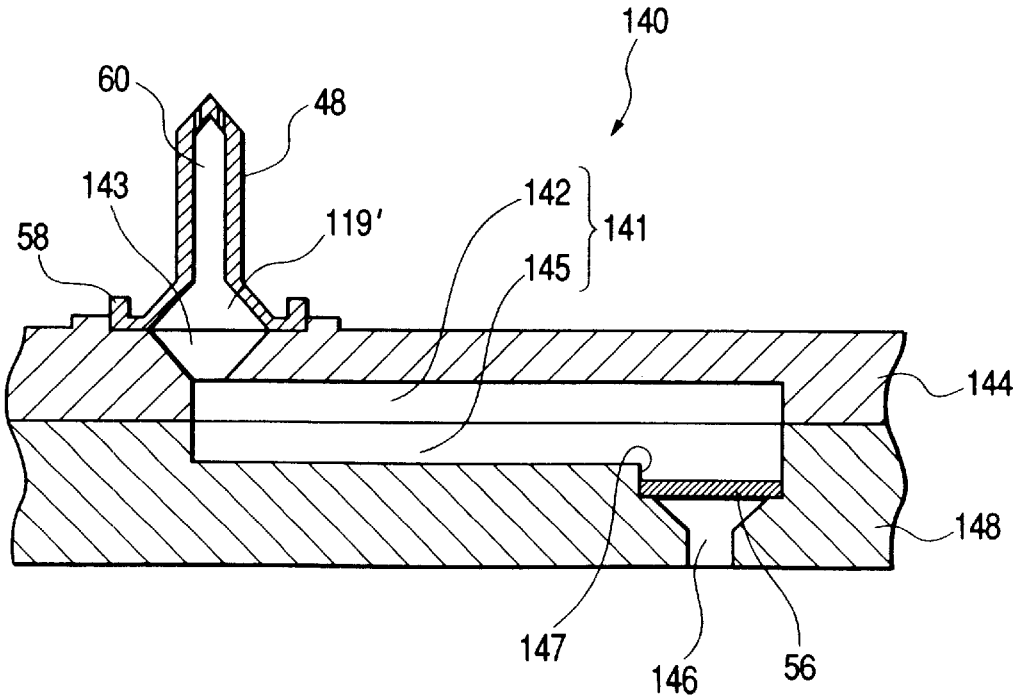
FIG. 23 is a partial, enlarged cross-sectional view of a convergent flow path unit for explaining a modification of the convergent flow path unit that is constituted by an upper flow path substrate and a lower flow path substrate.

Furthermore, as is shown in FIG. 23, a convergent flow path unit 140 may comprise: an upper flow path substrate 144, including upper flow path grooves 142, each constituting the upper portion of a convergent flow path 141, bases 58, to which the respective ink supply needle 48 are attached, and through holes 143, which respectively communicate the inner spaces 60 in the ink supply needles 48 to the convergent flow paths 141; and a lower flow path substrate 148, including lower flow path grooves 145, each constituting the lower portion of the corresponding convergent flow path 141, holes 146, which respectively communicate the lower flow path grooves 145 and the inlet ports 38*a* of the recording head 3, and filter holders 147, which respectively are located at the upstream ends of the holes 146 and hold the filters 56.

Since two plate members are employed to constitute the convergent flow path unit 140, the flow path unit 140 can be manufactured by performing only one joining process. Thus, the manufacturing efficiency can be improved.

With this arrangement, the upper flow path substrate 144 functions as an upper flow path groove plate in this embodiment, and the lower flow path substrate 148 functions as a lower flow path groove plate in this embodiment. Further, the inner space 60 in the ink supply needle 48 and the through hole 143 function as the first communication path in this embodiment, and the hole 146 below the filter 56 functions as the second communication in this embodiment.

Figure 24:
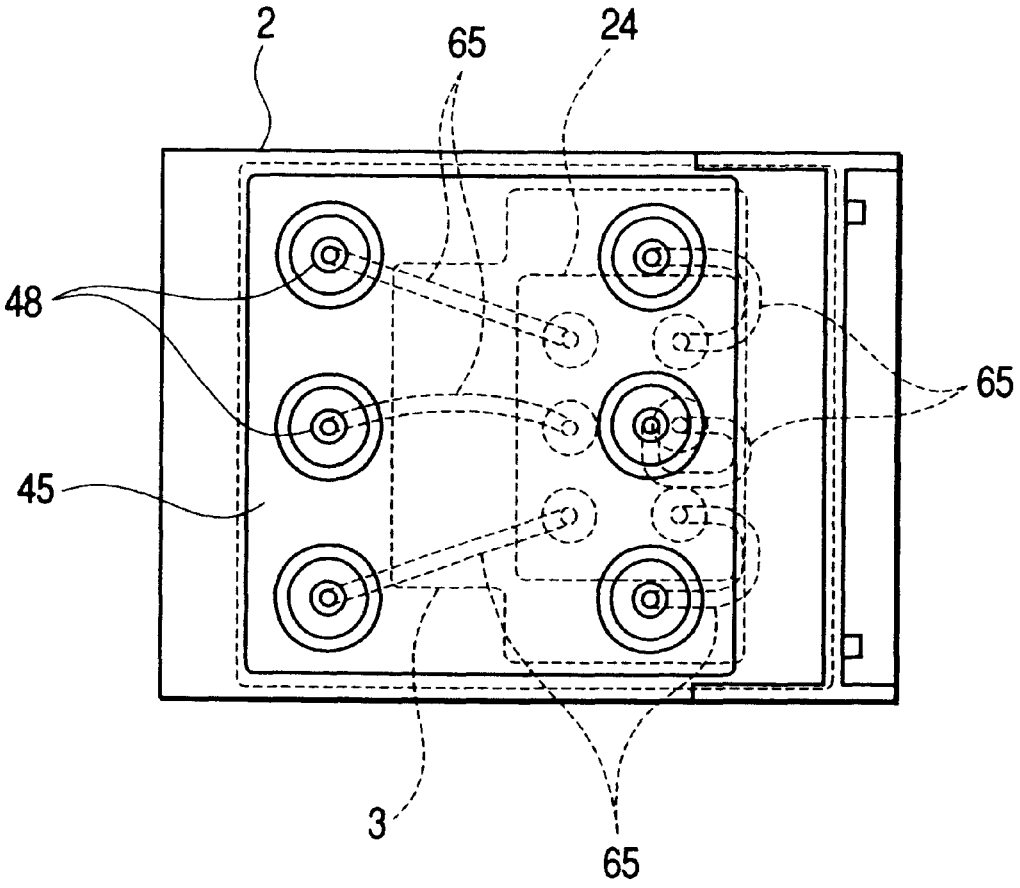
FIG. 24 is a diagram for explaining a modification for the ink flow paths for which the lengths were aligned.

The lengths of the convergent flow paths of the embodiments may be set to be equal to one another. Taking the convergent flow paths 65 of the first embodiment as an example, the flow path grooves 57 may be bent appropriately as shown in FIG. 24 to make the lengths of the flow path grooves 57.

When the lengths of the flow path grooves 57 are equal or uniform, the flow path resistance can be equalized for the individual convergent flow paths 65, that is, the flow resistances upstream of the inlet ports (ink inlets) 38*a* of the recording head 3 can be adjusted to provide uniform ink droplet ejection characteristics.

Furthermore, at least one of the plural plate members that constitute the convergent flow path unit may be composed of a transparent material. That is, transparent members may be employed through which the opposite side may be viewed. In this case, a transparent material such as an acrylic resin may be employed.

As is described above, when at least one of the plate members is made of a transparent material, during an after-assembly inspection, ink flow can be observed from outside the head unit, and a malfunction can be easily and accurately detected. As a result, the inspection process can be simplified, and manufacturing efficiency can be improved.

It should be noted that not only a transparent material, but also a semi-transparent material may be employed so long as the ink flow can be observed.

Further, an arbitrary combination of the embodiments can be employed. As an example, for the embodiments in which the ink supply needles 48 are separately provided from the plate member of the convergent flow path unit, the ink supply needles 48 and the plate member maybe integrally formed. With this arrangement, the number of parts can be reduced, and the assembly costs can be reduced. Whereas, as a contrasting example, for the embodiments in which the ink supply needles 48 are integrally formed with the plate member of the convergent flow path unit, the ink supply needles 48 may be provided as separate members from the convergent flow path unit.

So long as the filter 56 is provided to the second communication path, the same effects can be obtained. Thus, the filter 56 need only be located within a range extending from the upstream end to the downstream end of the second communication path.

The cartridge case 2, 81 or 102 is so designed that the ink cartridge 5, in which the inner space of the case main body 53 is divided into the plural ink chambers 52, can be mounted. However, the cartridge case that can be used is not limited to this structure. The cartridge case may be designed to mount a plurality of ink cartridges, each of which has a single ink chamber.

In the embodiments, the recording head 3 employs the piezoelectric vibrator 29*s* of the vertical vibration mode as the pressure generating element for pressuring the pressure generation chambers 30. The pressure generating element in this invention is not limited thereto. For example, the invention can be applied to a head unit having a recording head that employs deflection vibration mode piezoelectric vibrators, or a head unit having a recording head that employs a heat generation element to heat and evaporate ink in the pressure generation chambers 30.

The recording head unit of the invention can be preferably applied not only to the printer 1 but also other ink-jet recording apparatuses, such as a plotter, a copier, a facsimile machine, etc.

As is described above, the invention can provide the following effects.

Since an ink flow path is formed by a first communication path communicated with an ink outlet of a corresponding ink chamber, a second communication path communicated with a corresponding ink inlet of the recording head, and a convergent flow path communicating the first communication path with the second communication path, and since a filter is located in the second communication path, ink passed through the filter is immediately supplied to the recording head. Therefore, defective operations during which foreign substances enter a recording head can be completely eliminated. And since the portion of the ink flow path downstream of the filter is extremely short, the amount of foreign substances that could be attached to that portion during the manufacturing process can be reduced, and the time that is thereafter required for cleaning can also be reduced. Thus, the manufacturing efficiency can be improved.

Furthermore, since the convergent flow paths are arranged to converge toward the recording head, the first communication paths and the second communication paths can be shifted along the plane. Accordingly, the first communication paths can be disposed independently of opening pitches of the ink inlets provided to the recording head. Thus, the degree of design freedom can be increased, even for a recording head having a limited size, and a predetermined-or larger area can be easily obtained for the filter. And since the necessary area can be obtained for the filter, the capture of foreign substances and air bubbles can be effectively performed.

In a case where each convergent flow path inclines downward from the first communication path to the second communication path, ink smoothly flows along the flow paths to avoid the stay of air bubbles. Accordingly, ink ejection failures due to the stay of air bubble can be prevented.

In a case where the convergent flow path is formed horizontally, an increase in water head difference between the inlet and the outlet of the ink flow path can be prevented, even when the ink flow path is extended. Thus, even when a large ink cartridge or a small recording head is mounted, the ejection of ink droplets can be stabilized, and normal recording can be performed.

In a case where the convergent flow paths are formed in a plate-shaped convergent flow path unit constituted by a plurality of plate members, the structures of the plate members can be simplified, and the convergent flow path unit can be obtained merely by laminating and joining the plate members. Accordingly, the manufacturing process is simplified.

In a case where a portion of a lid plate closing the flow path groove is formed at least partially by a flexible portion that is elastically deformable by pressure change in ink flowing along the convergent flow path, ink pressure change, which is caused by the vibration of the ink cartridge, can be absorbed, and the ejection of ink droplets can be stabilized.

In a case where the second communication path is formed in a flowpath groove plate, and a filter holder for holding the filter is located at the upstream end of the second communication path, the flow path groove and the second communication path are formed in the same plate member. Thus, the entry of foreign substances can more appropriately be prevented.

Further, in a case where a protrusion is formed on a joining face of the lid plate to the flow path groove plate, which is smaller in width and height than the opening of the flow path groove, and the lid plate and the flow path groove plate are joined while the protrusion is fitted to the flow path groove, a gap is defined between a side wall of the protrusion and an inner wall of the flow path groove. Consequently, flashes caused by welding and excessive adhesive can be received in the gap, to thereby eliminate a possibility that air bubbles flowing with ink may be caught by flashes or hardened adhesive. Therefore, a defective operation, caused by reduction in effective area of the ink flow path due to the presence of air bubbles, can be prevented, and the ink can be supplied smoothly.

In a case where at least one of plates that constitute the convergent flow path unit is formed of a light-transmissible material, the inside of the head unit can be externally observed. Thus, the ink flow can be examined during an inspection, and an assembly failure can be easily discovered.

When thermal welding is performed to join plates that constitute the convergent flow unit, the plates can be efficiently assembled, so that manufacturing efficiency is improved and manufacturing costs are reduced.

When an adhesive is employed to bond plates that constitute the convergent flow path, the plates can be bonded without damage such as deformation.

When an adhesive that has a flowability is employed and a recessed portion that can receive excessive adhesive is formed around the bonded area, overflow of the adhesive can be prevented. Thus, a defective operation, encountered when excessive leaks into the ink flow path to cause the stay of air bubbles, can be prevented.

When ultrasonic welding is performed to join plates that constitute the convergent flow path unit, the bonding and liquid-tight sealing of the plates can be performed at the same time, and no drying process is required. Thus, the manufacturing efficiency can be improved.

In a case where the filter is located at an intermediate portion of the second communication path and a portion of the second communication path upstream of the filter is expanded in cross-sectional area toward the filter, a large effective area for the filter can be obtained to avoid the stay of air bubbles. In addition, the ink can flow smoothly.

In a case where the air bubble holding space is formed at an intermediate portion of the ink flow path, air bubbles that have entered the ink flow path can be held in the air bubble holding space. Thus, an ink ejection failure due to the entry of air bubbles into the recording head can be prevented.

In a case where a ceiling surface of the convergent flow path is inclined upward from the second communication path toward the first communication path, the ink smoothly flows along the ink flow path to avoid the stay of air bubbles. Thus, ejection failures that occur due to the stay of air bubbles can be prevented, and the ejection of ink droplets can be stabilized. Further, when a first air bubble holding space is formed, the air bubbles easily flow along the ceiling surface to the first air bubble holding space, and the entry of air bubbles into the recording head can be fully prevented.

In a case where the lengths of the convergent flow paths are set to be equal, flow path resistance of the ink flow paths can be equalized, and uniform ink droplet ejection characteristics can be obtain for all the ink flow paths.

What is claimed is:

1. A recording unit comprising:

a cartridge holder adapted to replaceably mount at least one ink cartridge defining a plurality of ink chambers;

a recording head, for ejecting ink in response to activation of a pressure generating element;

a plurality of ink flow paths through which ink in the ink chambers is supplied to the recording head, respectively, each of the ink flow paths including a first communication path communicated with an ink outlet of the corresponding ink chamber, a second communication path communicated with a corresponding ink inlet of the recording head, and a convergent flow path communicating the first communication path with the second communication path, convergent flow paths being arranged to converge toward the recording head; and a filter respectively disposed in each of second communication paths;

wherein the filter is disposed in only an opening portion of the second communication path connected with an end of the convergent flow path.

2. A recording head unit according to claim 1, wherein each of the convergent flow paths is downwardly inclined from the corresponding first communication path to the second corresponding communication path.

3. A recording head unit according to claim 2, wherein ceiling faces of the convergent flow paths incline upward from the second communication paths to the first communication paths.

4. A recording head unit according to claim 1, wherein each of the convergent flow paths extends horizontally.

5. A recording head unit according to claim 4, wherein the convergent flow paths are formed in a convergent flow path unit in the form of a plate.

6. A recording head unit according to claim 5, wherein the convergent flow path unit includes a flow path grooved plate having a plurality of flow path grooves for forming the convergent flow paths, and a lid plate for closing openings of the flow path grooves.

7. A recording head unit according to claim 6, wherein a first communication portion provided with the first communication paths is integral with the lid plate.

8. A recording head unit according to claim 7, wherein the first communication portion is constituted by ink supply needles that are inserted into the at least one ink cartridge to supply ink from the ink chambers.

9. A recording head unit according to claim 6, wherein protrusions are formed, on joining face of the lid plate to the flow path grooved plate, that are narrower than widths of the openings of the flow path grooves and lower than depths of the flow path grooves; and wherein, when the lid plate and the flow path grooved plate are joined together in a state that the protrusions are fitted to the flow path grooves, gaps are defined between side walls of the protrusions and inner walls of the flow path grooves.

10. A recording head unit according to claim 6, wherein the second communication paths are formed in the flow path groove plate, and filter holders, for holding the filters, are positioned at the upstream ends of the second communication paths.

11. A recording head unit according to claim 6, wherein the lid plate has flexible portions at least partially sealing the flow path grooves, and each of the flexible portions is elastically deformable by-pressure change in the ink flowing along the corresponding convergent flow path.

12. A recording head unit according to claim 5, wherein the convergent flow path unit comprises an opening plate, in which through holes that serve as the convergent flow paths are formed in the direction of the thickness of the convergent flow path unit, an upper lid plate, for sealing upper openings of the through holes, and a lower lid plate, for sealing lower openings of the through holes.

13. A recording head unit according to claim 12, wherein a first communication portion provided with the first communication paths, is an integral with the upper lid plate.

14. A recording head unit according to claim 12, wherein the second communication paths are formed in the lower lid plate, and filter holders, for holding the filters, are located at upstream ends of the second communication paths.

15. A recording head unit according to claim 5, wherein the convergent flow path unit includes an upper flow path grooved plate, in which upper flow path grooves are formed to constitute upper portions of the convergent flow paths, and a lower flow path grooved plate, in which lower flow path grooves are formed to constitute lower portions of the convergent flow paths.

16. A recording head unit according to claim 15, wherein the second communication paths are formed in the lower flow path grooved plate, and filter holders, for holding the filters, are positioned at upstream ends of the second communication paths.

17. A recording head unit according to claim 5, wherein at least one of plates that constitute the convergent flow path unit is formed of a transparent or semi-transparent material.

18. A recording head unit according to claim 5, wherein plates constituting the convergent flow path unit are joined together by an adhesive.

19. A recording head unit according to claim 18, wherein the adhesive flows easily, and recessed portions in which excessive adhesive can be accommodated are formed around adhered areas.

20. A recording head unit according to claims 5, wherein plates that constitute the convergent flow path unit are joined together by ultrasonic welding.

21. A recording head unit according to claim 5, wherein plates constituting the convergent flow path unit are joined together by thermal welding.

22. A recording head unit according to claim 1, wherein, portions of the second communication units, downstream of the filters, are decreased in diameter toward a downstream side to present a funnel shape.

23. A recording head unit according to claim 1, wherein air bubble holding spaces, in which air bubbles are to be retained, are formed in intermediate portions of the ink flow paths.

24. A recording head unit according to claim 23, wherein the air bubble holding spaces include first air bubble holding spaces formed by partially increasing the diameters of the first communication paths.

25. A recording head unit according to claim 23, wherein the air bubble holding spaces include second air bubble holding spaces formed by partially increasing the diameters of the ink flow paths, the second air bubble holding spaces being adjacent to an upstream of the filters.

26. A recording head unit according to claim 23, wherein the air bubble holding spaces include first air bubble holding spaces, formed by partially increasing the diameters of the first communication paths, and second air bubble holding spaces, formed by partially increasing the diameters of ink flow paths, the second air bubble holding spaces being adjacent to and upstream of the filters; and wherein the volume of each of the first air bubble holding spaces is greater than the volume of each of the second air bubble holding spaces.

27. A recording head unit according to claim 1, wherein the filters are located at intermediate portions of the second communication paths; and wherein portions of the second communication paths, upstream of the filters, are increased in diameter as the portions approach the filters.

28. A recording head unit according to claim 1, wherein different types of ink are stored in the ink chambers; and wherein the ink flow paths are respectively formed for the different types of ink.

29. A recording head unit according to claim 1, wherein the convergent flow paths have the same length.

30. A recording head unit according to claim 1, wherein the recording head includes:

nozzle openings, through which ink droplets are to be ejected; and pressure generation chambers communicated with the nozzle openings, wherein ink pressure in a desired one of the pressure generation chambers is changed by the pressure to eject the ink droplets through the corresponding nozzle opening, and wherein piezoelectric vibrators, which can vary the volumes of the respective pressure generation chambers, are employed as the pressure generating element.

31. A recording head unit according to claim 30, wherein the piezoelectric vibrators are piezoelectric vibrators of a vertical vibration mode.

32. A recording head unit according to claims 1, further comprising:

nozzle openings, through which ink droplets are ejected; and pressure generation chambers communicated with the nozzle openings, wherein ink pressure in a desired one of the pressure generation chambers is changed by the pressure generating element to eject the ink droplets through the corresponding nozzle opening, and wherein heat generation devices that can generate air bubbles in the respective pressure generation chambers are employed as the pressure generating element.

33. A recording head unit according to claim 1, wherein the filter is disposed so as to be continuous and flush with a bottom face of the second communication path.

34. A recording head unit according to claim 1, wherein the first communication path and the second communication path are arranged so as to shift each other in a direction in which the convergent flow path extends;

wherein the filter is not disposed in the first communication path, and wherein the filter is disposed in only the second communication path.

35. A recording head unit according to claim 1, wherein the filter is disposed in the second communication path, and wherein a portion of the second communication path, upstream of the filter is increased in a diameter as the portion toward the filter.

36. A recording head unit according to claim 1, wherein the filter is not overlapped with the first communication path as viewed in a direction in which the first communication path extends.

37. A recording head unit according to claim 1, wherein the first communication path and the second communication path are arranged so as to shift each other in a direction in which the convergent flow path extends.

38. A recording head unit according to claim 1, wherein the convergent flow path is extended in a horizontal direction.

39. A recording head unit according to claim 1, wherein the first communication path and the second communication path are extended in a substantially same direction.

40. A recording head unit comprising:

a cartridge holder adapted to replaceably mount at least one ink cartridge defining a plurality of ink chambers;

a recording head for ejecting ink in response to activation of a pressure generating element;

a plurality of ink flow paths through which ink in the ink chambers is supplied to the recording head, respectively, each of the ink flow paths including a first communication path communicated with an ink outlet of the corresponding ink chamber, a second communication path communicated with a corresponding ink inlet of the recording head, and a convergent flow path communicating the first communication path with the second communication path, convergent flow paths being arranged to converge toward the recording head; and a filter respectively disposed in each of second communication paths, wherein the filter is disposed on a position in the second communication path lower than a bottom of the convergent flow path extended in a substantially horizontal direction.

41. A recording head unit according to claim 40, wherein the first opening portion is provided between the first communication path and the convergent flow path;

wherein a second opening portion is provided between the convergent flow path and the second communication path; and wherein the filter is disposed downstream of the second opening portion.

42. A recording head unit according to claim 40, wherein the filter is disposed so as to be continuous and flush with a bottom face of the second communication path.

43. A recording head unit according to claim 40, wherein the first communication path and the second communication path are arranged so as to shift each other in a direction in which the convergent flow path extends;

wherein the filter is not disposed in the first communication path; and wherein the filter is disposed in only the second communication path.

44. A recording head unit according claim 40, wherein the filter is disposed in only an opening portion of the second communication path connected with an end of the convergent flow path.

45. A recording head unit according to claim 40, wherein the filter is disposed in the second communication path; and wherein a portion of the second communication path, upstream of the filter, is increased in a diameter as the portion toward the filter.

46. A recording head unit according to claim 40, wherein the filter is not overlapped with the first communication path as viewed in a direction in which the first communication path extends.

47. A recording head unit according to claim 40, wherein the convergent path extends from the first opening portion and terminates at the second opening portion.

48. A recording head unit according to claim 40, wherein the first opening portion is offset for the second opening portion in a direction in which the convergent flow path extends.

49. A recording head unit according to claim 40, wherein the first communication path and the second communication path are arranged so as to shift each other in a direction in which the convergent flow path extends.

50. A recording head unit according to claim 40, wherein the first communication path and the second communication path are extended in a substantially same direction.

* * * * *